US009731520B2

(12) United States Patent
Matsui

(10) Patent No.: US 9,731,520 B2
(45) Date of Patent: Aug. 15, 2017

(54) PRINTING SYSTEM WITH TRAY AND REMAINDER SENSORS AND METHOD OF CONTROLLING PRINTING SYSTEM HAVING NOTIFICATION FEATURE

(71) Applicant: BROTHER KOGYO KABUSHIKI KAISHA, Nagoya, Aichi (JP)

(72) Inventor: Yuki Matsui, Kiyosu (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 0 days.

(21) Appl. No.: 15/277,251

(22) Filed: Sep. 27, 2016

(65) Prior Publication Data

US 2017/0087883 A1 Mar. 30, 2017

(30) Foreign Application Priority Data

Sep. 30, 2015 (JP) ..... 2015-195025

(51) Int. Cl.

| | |
|---|---|
| ***B65H 7/02*** | (2006.01) |
| ***B41J 11/00*** | (2006.01) |
| ***B41J 29/48*** | (2006.01) |
| *B65H 43/02* | (2006.01) |
| *B65H 7/04* | (2006.01) |
| *B41J 29/46* | (2006.01) |

(52) U.S. Cl.

CPC ..... *B41J 11/0075* (2013.01); *B41J 29/48* (2013.01); *B65H 7/02* (2013.01); *B41J 29/46* (2013.01); *B65H 7/04* (2013.01); *B65H 43/02* (2013.01); *B65H 2511/30* (2013.01); *B65H 2511/514* (2013.01); *B65H 2551/212* (2013.01)

(58) Field of Classification Search

CPC ... B65H 7/02; B65H 7/04; B65H 43/02; B41J 11/0075; B41J 29/46; B41J 29/48

See application file for complete search history.

(56) References Cited

U.S. PATENT DOCUMENTS

2008/0258374 A1* 10/2008 Inoue ..... B65H 3/44 271/9.03

FOREIGN PATENT DOCUMENTS

| | | | |
|---|---|---|---|
| JP | 2007008626 | A | 1/2007 |
| JP | 2007008627 | A | 1/2007 |
| JP | 2011008211 | A | 1/2011 |

* cited by examiner

*Primary Examiner* — Howard Sanders

(74) *Attorney, Agent, or Firm* — Scully, Scott, Murphy & Presser, PC

(57) ABSTRACT

In a printing system, an attached-time remaining sheet amount at detecting attachment of a sheet feed tray to the printing system is detected. And current remaining sheet amount at end of image printing is detected. Then, it is determined whether the attached-time sheet remaining amount is greater than a first threshold value. In response to determination that an attached-time sheet remaining amount is greater than a threshold value and the current remaining sheet amount is less than or equal to the threshold value, a controller executes an alert process corresponding to controlling a display to display an alert. In response to determination that the attached-time sheet remaining amount and the current remaining sheet amount are equal to or less than the first threshold value, the controller inhibits executing the alert process.

8 Claims, 18 Drawing Sheets

PRINTING SYSTEM WITH TRAY AND REMAINDER SENSORS AND METHOD OF CONTROLLING PRINTING SYSTEM HAVING NOTIFICATION FEATURE

CROSS-REFERENCE TO RELATED APPLICATION

This application claims priority under 35 U.S.C. §119 from Japanese Patent Application No. 2015-195025 filed on Sep. 30, 2015. The entire subject matter of the application is incorporated herein by reference.

BACKGROUND

Technical Field

The present disclosures relate to a printing system and a method of controlling the printing system.

Related Art

Conventionally, there has been known an image forming apparatus configured to detect a remaining amount of sheets in a sheet feed tray, and notify a user of an alert when the detected remaining amount of the sheets is less than a particular threshold level. In such a conventional image forming apparatus, by selecting one of a plurality of threshold levels, the user can set whether the alert is output well before running-out of the sheets or not.

SUMMARY

In the conventional image forming apparatus as described above, at a time when the user attaches the sheet feed tray to the image forming apparatus, if the amount of the sheet accommodated in the sheet feed tray is smaller than the threshold level, the alert would be output. However, at a time when the user attaches the sheet feed tray to the image forming apparatus, the user has already known that the amount of the sheets accommodated in the sheet feed tray is relatively small, and such an alert notification at the time of attaching the sheet feed tray to the image forming apparatus is bothersome to the user.

In view of the above, according to aspects of the disclosures, there are provided a printing system and a method of controlling the printing system, which provide excellent usability by not outputting an alert when it is unnecessary to output the alert regarding the remaining amount of the sheets.

According to aspects of the disclosures, there is provided a printing system which is provided with a sheet feed tray, a tray sensor configured to output signal corresponding to attachment of the sheet feed tray to the printing system, a remainder sensor configured to output a signal depending on a remaining sheet amount in the sheet feed tray, a sheet feeder configured to feed the sheet in the sheet feed tray, a printer configured to print an image on the sheet fed by the sheet feeder, a display and controller. The controller is configured such that, in response to receipt of the signal from the tray sensor, the controller detects the attachment of the sheet feed tray to the printing system, and in response to receipt of the signal from the remainder sensor at detecting the attachment of the sheet feed tray, the controller detects an attached-time remaining sheet amount in the sheet feed tray. Further, the controller is configured to determine whether the attached-time sheet remaining amount is greater than a threshold value, control the sheet feeder to feed the sheet from the sheet feed tray and control the printer to print an image on the one of the sheets fed by the sheet feeder, in response to receipt of the signal from the remainder sensor at end of printing the image, detect a current remaining sheet amount in the sheet feed tray, determine whether the current remaining sheet amount is greater than the threshold value, in response to determination that the attached-time sheet remaining amount is greater than the threshold value and determination that the current remaining sheet amount is equal to or less than the threshold value and, execute an alert process corresponding to control the display to display an alert on the display, and in response to determination that the attached-time sheet remaining amount and the current remaining sheet are equal to or less than the threshold value, inhibit executing the alert process.

According to aspects of the disclosures, there is also provided a method implemented by a controller for controlling a printing system having a tray sensor for outputting signal corresponding to attachment of a sheet feed tray to the printing system and a remainder sensor for outputting signal depending on a remaining sheet amount in the sheet feed tray. The method includes, in response to receipt of the signal from the tray sensor, detecting the attachment of the sheet feed tray to the printing system, and in response to receipt of the signal from the remainder sensor at detecting the attachment of the sheet feed tray, detecting an attached-time remaining sheet amount in the sheet feed tray. The method further includes determining whether the attached-time sheet remaining amount is greater than a threshold value, controlling a sheet feeder of the printing system to feed the sheet from the sheet feed tray and control a printer of the printing system to print an image on the one of the sheets fed by the sheet feeder, in response to receipt of the signal from the remainder sensor at end of printing the image, detecting a current remaining sheet amount in the sheet feed tray, determining whether the current remaining sheet amount is greater than the threshold value, and execute an alert process corresponding to control the display to display an alert regarding the remaining sheet amount on the display. In response to determination that the attached-time sheet remaining amount and the current remaining sheet are equal to or less than the threshold value, the method inhibits executing the alert process.

BRIEF DESCRIPTION OF THE ACCOMPANYING DRAWINGS

FIG. 1 is a block diagram showing a functional configuration of the printing system according to a first illustrative embodiment of the disclosures.

FIG. 2 schematically shows an appearance of the printing system shown in FIG. 1 according to the first illustrative embodiment of the disclosures.

DESCRIPTION OF THE EMBODIMENTS

Hereinafter, referring to the accompanying drawings, embodiments of the present disclosures will be described. It is noted that, in all the accompanying drawings, the same components or corresponding members are assigned with the same reference numbers, and duplicated description will not be provided. Further, in all the drawings, components necessary to be described are shown but other components may be omitted. Further, aspects of the disclosures need not be limited to configurations of the illustrative embodiments described below.

First Embodiment

Configuration of Printing System

Figure 1:
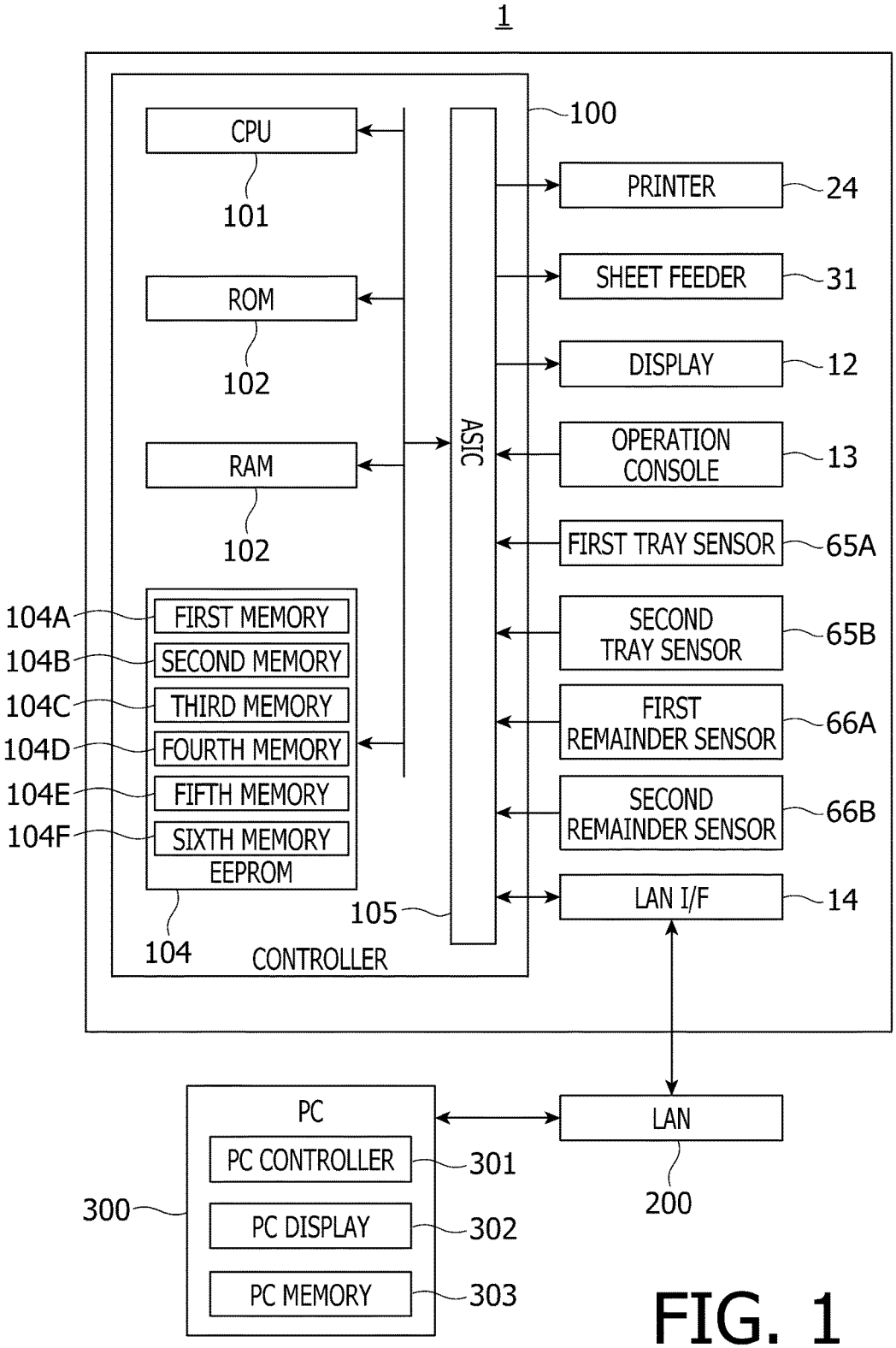
Figure 2:
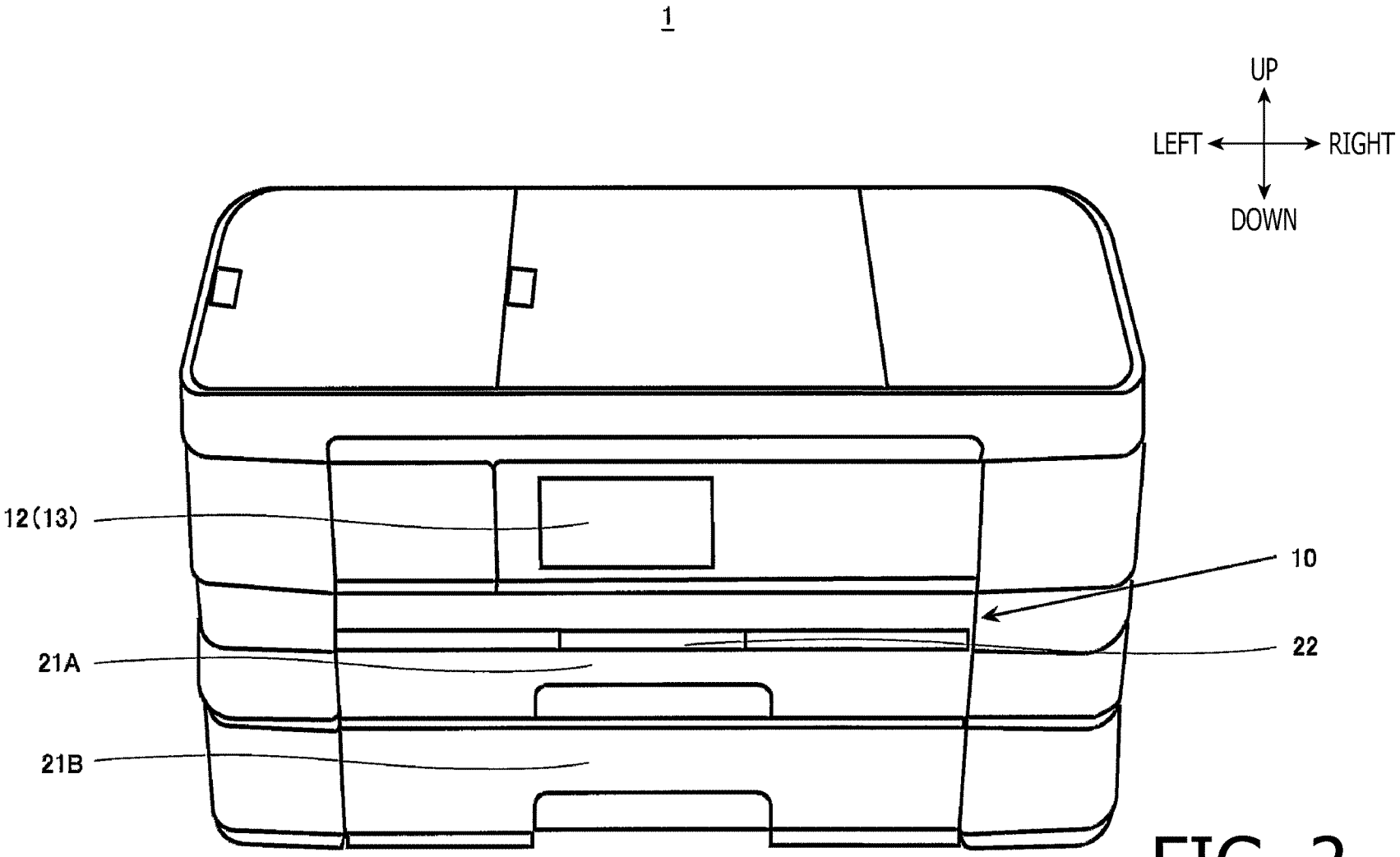
Figure 3:
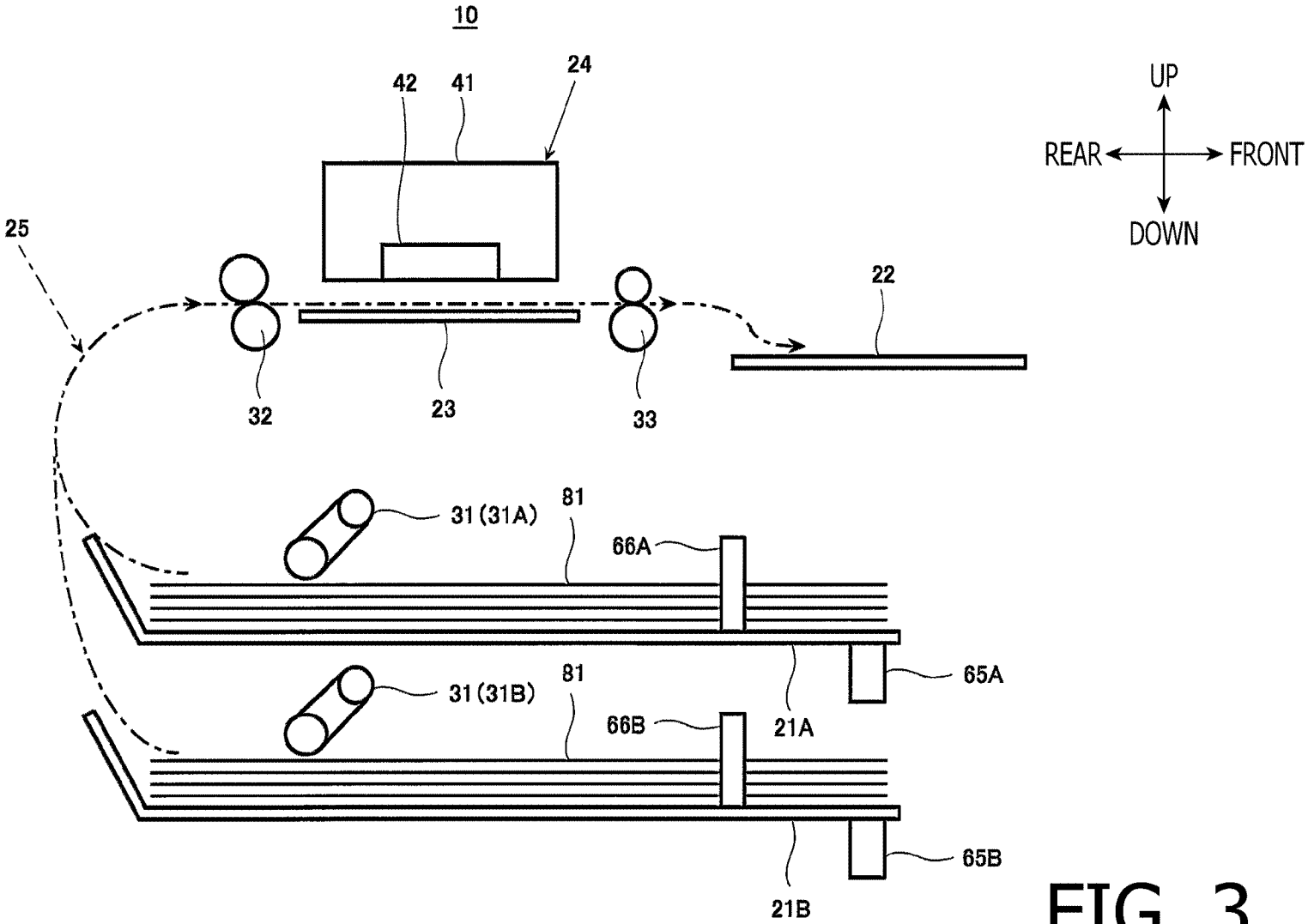
FIG. 3 is a cross-sectional side view schematically showing an inner configuration of the printing system according to the first illustrative embodiment of the disclosures.

FIG. 2 shows an appearance of a printing system 1 and FIG. 3 is a cross-sectional view showing an inner configuration of the printing system 1. FIG. 1 is a block diagram illustrating a functional configuration of the printing system 1. In FIGS. 2 and 3, up, down, right, left, front and rear directions of the printing system 1 are indicated by arrows.

As shown in FIGS. 1 and 2, the printing system 1 according to the first illustrative embodiment has a printer assembly 10, a display 12, an operation console (i.e., a manipulator) 13.

As shown in FIG. 3, the printer assembly 10 has a first sheet feed tray 21A, a second sheet feed tray 21B, the discharge tray 22, a platen 23 and a printer 24. The first sheet feed tray 21A is arranged above the second sheet feed tray 21B. The printer assembly 10 is configured to print an image on a sheet 81 supplied from the first sheet feed tray 21A or the second sheet feed tray 21B, and the sheet 81 on which the image has been formed is discharged onto a sheet discharge tray 22.

Above the first sheet feed tray 21A, the platen 23 is arranged. Further, above the platen 23, the printer 24 having a carriage 41 and a print head 42 configured to eject ink droplets through nozzles is arranged. Further, the discharge tray 22 is arranged on a front side with respect to the platen 23.

From rear sides of the first sheet feed tray 21A and the second sheet feed tray 21B to the discharge tray 22, a sheet conveyance passage 25 is defined by not-shown members. The sheet conveyance passage 25 is, as shown in FIG. 3, formed to extend upward from the rear sides of the first and second sheet feed trays 21A and 21B and curves frontward to from a U-shape.

The printer assembly 10 has a sheet feeder 31, a conveyance roller pair 32 and a discharge roller pair 33. The sheet 81 fed into the sheet conveyance passage 25 by the sheet feeder 31 is conveyed through the sheet conveyance passage 25 by the conveyance roller pair 32 and the discharge roller pair 33.

The sheet feeder 31 has a first feed roller 31A and a second feed roller 31B. According to the illustrative embodiments, the first feed roller 31A is arranged immediately above the first sheet feed tray 21A, and is configured to feed the sheets 81 in the first sheet feed tray 21A, one by one, toward the sheet conveyance passage 25. Similarly, the second feed roller 31B is arranged immediately above the second sheet feed tray 21B, and is configured to feed the sheets 81 in the second sheet feed tray 21B, one by one, toward the sheet conveyance passage 25. It is noted that one of the first feed roller 31A and the second feed roller 31B is selectively driven in accordance with a job which the controller 100 obtains.

The printer assembly 10 has a first remainder sensor 66A and a second remainder sensor 66B. The first and second remainder sensors 66A and 66B are configured to output signals corresponding to remaining amounts of the sheets 81 in the first and second sheet feed trays 21A and 21B to the controller 100, respectively. The controller 100 calculates a remaining amount of the sheets 81 in each of the sheet feed trays 21A and 21B based on the signals received from the first and second remainder sensors 66A and 66B.

The printer assembly 10 is further provided with a first tray sensor 65A and a second tray sensor 65B. Each of the first and second sheet feed trays 21A and 21B is movable, by a user operation, between an attached position and a detached position. The first and second tray sensors 65A and 65B are configured to transmit signals corresponding to positions of the first and second sheet feed trays 21A and 21B to the controller 100, respectively.

Specifically, in a state where the first sheet feed tray 21A is located at the attached position (hereinafter, referred to as an attached state), the first tray sensor 65A transmits a signal corresponding to the attached state to the controller 100. While, in a state where the first sheet feed tray 21A is located at the detached position (hereinafter, referred to as a detached state), the first tray sensor 65A transmits a signal corresponding to the detached state to the controller 100. Similarly, the second tray sensor 65B is configured to transmits the signals corresponding to the attached/detached states to the controller 100 depending on the locations of the second sheet feed tray 21B.

It is noted that the "attached state" may be defined as a state where the first sheet feed tray 21A or the second sheet feed tray 21B is located at the attached position, and the sheet 81 supported by the first sheet feed tray 21A or the second sheet feed tray 21B located at the attached position can be supplied to the sheet conveyance passage 25 by the first feed roller 31A or the second feed roller 31B.

Further, it is noted that the "detached state" may be defined as a state where the first sheet feed tray 21A or the second sheet feed tray 21B is located at the detached position, and the sheet 81 in the first sheet feed tray 21A or the second sheet feed tray 21B which is located at the detached position cannot be supplied to the sheet conveyance passage 25. Therefore, the "detached state" does not require that the sheet feed tray is completely removed from the printer assembly 10. That is, the "detached state" could mean that the sheet feed tray is withdrawn from the printer assembly 10 by a certain amount.

Next, referring to FIGS. 1-3, components of the printing system 1 other than the printer assembly 10 will be described.

As shown in FIG. 2, the display 12 is arrange at an upper front part of the printing system 1 (more particularly, on an upper part with respect to the discharge tray 22). The display 12 is configured to display information to be notified to the user by displaying an information screen including messages and the like. A concrete structure of the display 12 need not be limited to a particular one, and the display 12 may be a liquid crystal display, an organic EL (electroluminescence) display, a lamp such as LED (light emitting diode) and the like.

It is noted that, according to the first embodiment, the display 12 employs a so-called single window type display capable of switching a plurality of display screens displayed thereon.

Further, according to the first illustrative embodiment, the display 12 is one provided to the printing system 1. However, this is only an illustrative configuration and the display 12 need not be limited to such a configuration. For example, the display 12 may be configured by a PC (personal computer) display 302 provided to a PC (personal computer) 300 as will be described later.

According to the illustrative embodiment, the display 12 is provided with a touch sensor so that the display 12 also serves as an operation console 13. The operation console 13 is an interface configured to receive instructions to the printing system 1 from the user, and configured by the touch panel according to the first illustrative embodiment as mentioned above.

It is noted that, according to the first illustrative embodiment, the operation console 13 is configured by the touch panel. However, this is an illustrative configuration and the operation console 13 need not be limited to such a configuration. As far as the operation console 13 is physically separated from the printing system 1 and communicable with the controller 100, any other device such as a remote controller, a cellular phone, a smartphone and the like can be used as the operation console 13. It is also noted that the operation console 13 may be configured by multiple buttons and the like provided to the printing system 1.

As shown in FIG. 1, the printing system has a LAN (local area network) I/F (interface) 14 and a controller 100. The LAN I/F 14 is an interface used to connect the printing system 1 with the PC 300 through the LAN 200. The print data transmitted by the PC 300 is received by the controller 100 through the LAN 200 and LAN I/F 14.

The controller 100 has a CPU (central processing unit) 101, a ROM (read only memory) 102, a RAM (random access memory) 103, an EEPROM (electrically erasable ROM) 104 and an ASIC (application specific integrated circuit) 105. According to the illustrative embodiments, drivers (not shown), the display 12, the operation console 13, the first tray sensor 65A, the second tray sensor 65B, the first remainder sensor 66A and the second remainder sensor 66B are connected to the ASIC 105.

In response to receipt of a print job (hereinafter, simply referred to as a job) from the PC 300 through the LAN 200 and the LAN I/F 14, the CPU 101 transmits an instruction to execute the job to the ASIC 105 based on the program stored in the ROM 102. In response to the instruction, the ASIC 105 drives respective drivers (not shown) to execute a printing operation. It is noted that data indicating a currently executed job is stored in the RAM 103 or the like, but such data indicating the job is deleted from the RAM 103 when the job has been completed.

The EEPROM 104 has first to sixth memories 104A-104F, in which a type (e.g., normal sheet, glossy sheet etc.) of the sheet 81 accommodated in the first sheet feed tray 21A or the second sheet feed tray 21B, information regarding remaining amount of the sheet 81 in the first sheet feed tray 21A or the second sheet feed tray 21B or information regarding the number of sheets 81 fed from the first sheet feed tray 21A or the second sheet feed tray 21B are stored.

The type of the sheet 81 (hereinafter, referred to as a sheet type) is stored in respective memories of the EEPROM 104 in accordance with, for example, the user operation with respect to the operation console 13. The remaining amount of the sheets 81 (hereinafter, referred to as a remaining sheet amount) is calculated by the controller 100 based on the signal received from the first remainder sensor 66A or the second remainder sensor 66B. Further, the remaining sheet amounts for respective sheet feed trays calculated by the controller 100 are store in respective memories within the EEPROM 104.

Specifically, in the first memory 104A, the sheet type and remaining sheet amount PA1 in the first sheet feed tray 21A when the first sheet feed tray 21A has been attached to the printing system 1 are stored. In the second memory 104BA, the sheet type and remaining sheet amount PA2 in the second sheet feed tray 21B when the second sheet feed tray 21B has been attached to the printing system 1 are stored.

In the third memory 104C, current (i.e., when the signal is output from the first remainder sensor 66A other than a case where the first sheet feed tray 21A has been attached to the printing system 1) sheet type and remaining sheet amount PN1 in the first sheet feed tray 21A are stored. In the fourth memory 104D, the current sheet type and remaining sheet amount PN2 in the second sheet feed tray 21B are stored.

In the fifth memory 104E, the number PF1 of the sheets 81 supplied from the first sheet feed tray 21A to the sheet conveyance passage 25 by the first feed roller A is stored. In the sixth memory 104F, the number PF2 of the sheets 81 supplied from the second sheet feed tray 21B to the sheet conveyance passage 25 by the second feed roller B is stored.

Further, the EEPROM 104 has memories for alert flags, which will be described later, respectively corresponding to the first and second sheet feed trays 21A and 21B. It is noted that the sheet type and remaining sheet amount PN1 of the sheet 81 currently accommodated in the first sheet feed tray 21A, and the sheet type and remaining sheet amount PN2 of the sheet 81 currently accommodated in the second sheet feed tray 21B may be stored in the RAM 103.

Operation of Printing System

Next, operations of the printing system 1 according to the first illustrative embodiment will be described referring to FIGS. 1-11B.

<Operation when Printing System is Started>

Figure 4:
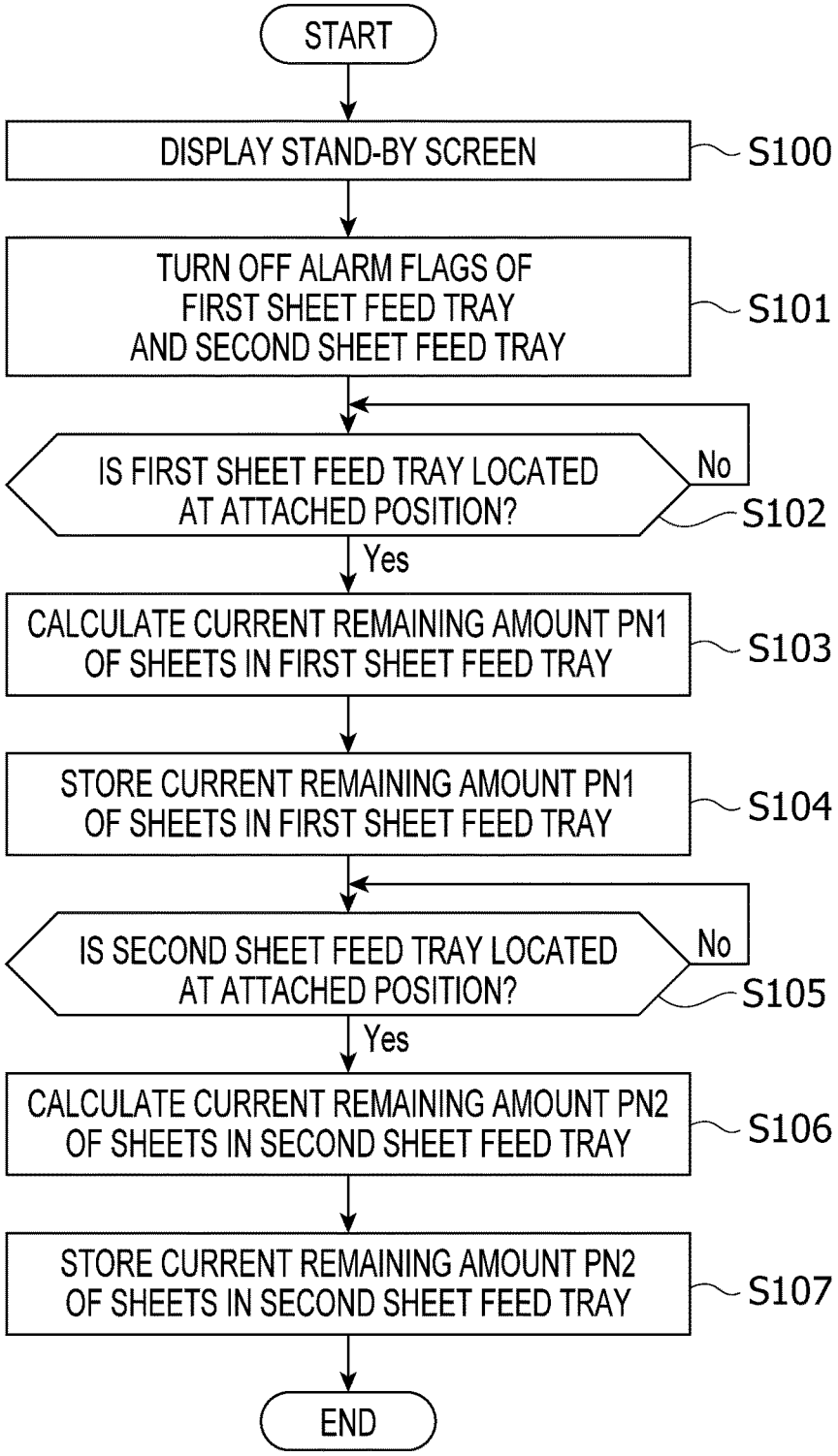
FIG. 4 is a flowchart illustrating a process executed by a controller of the printing system according to the first illustrative embodiment of the disclosures.

FIG. 4 is a flowchart illustrating a process executed by the controller 100 when the printing system 1 according to the first embodiment is started. It is noted that a program (or programs) corresponding to the process shown in FIG. 4 is stored in the RAM 102. Further, it is noted that the process shown in FIG. 4 and is executed by the CPU 100 will be referred to, hereinafter, as a start-up process.

When the user depresses a power button of the printing system 1 to power on the printing system 1, the controller 100 retrieves programs to execute respective steps of the flowchart shown in FIG. 4, and executes the same.

As shown in FIG. 4, the controller 100 causes the display 12 to display a standby screen 5 (see FIG. 5) (S100). It is noted that the controller 100 may cause the PC display 302 to display the standby screen 5.

Next, referring to FIG. 5, the standby screen 5 displayed on the display 12 will be described.

Figure 5:
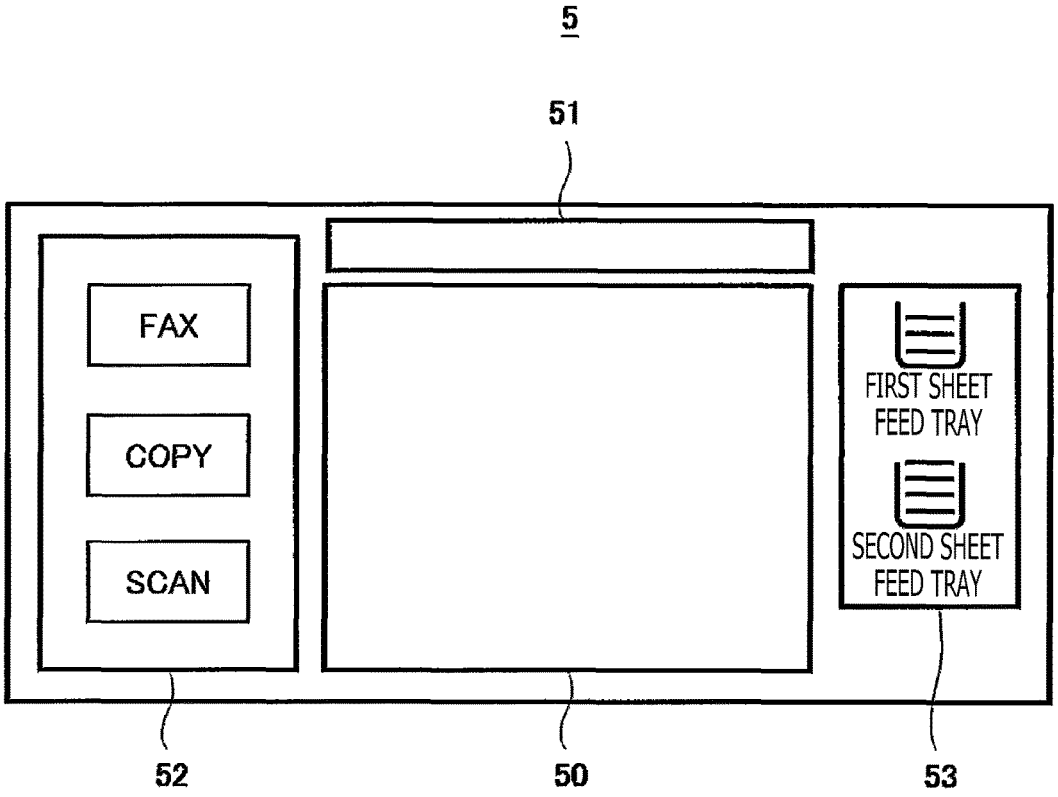
FIG. 5 shows an example of a standby screen displayed on a display of the printing system according to the first illustrative embodiment of the disclosures.

FIG. 5 schematically shows an example of the standby screen 5 displayed on the display 12 of the printing system 1.

As shown in FIG. 5, in the standby screen 5, a main image area 50, a sub image area 51, an operation area 52 and a remaining sheet amount display area 53 are arranged. In the operation area 52, buttons respectively causing the printing system 1 to execute functions of facsimile (FAX), copy (COPY) and scanning (SCAN) are displayed. In the main image area 50, screen to make detail setting when executing the functions of facsimile, copying or scanning, or a second alert screen (described later) is displayed.

Further, in the sub image area 51, a first alert screen (described later) is displayed. In the remaining sheet amount display area 53, pictures (icons) schematically showing the remaining sheet amounts in the first sheet feed tray 21A and the second sheet feed tray 21B are displayed. It is noted that the pictures to be shown in the remaining sheet amount display area 53 may be displayed within the main image area 50.

Next, the controller 100 sets the alert flags of the first sheet feed tray 21A and the second sheet feed tray 21B in the EEPROM 104 to "OFF" (S101). Then, the controller 100 determines whether the first sheet feed tray 21A is located at the attached position based on the signal output by the first tray sensor 65A (S102).

When it is determined that the first sheet feed tray 21A is located at the detached position (S102: NO), the controller 100 repeats executing S102 until the first tray sensor 65A outputs the signal indicating that the first sheet feed tray 21A is located at the attached position (i.e., until the user attaches the first sheet feed tray 21A to the printing system 1).

It is noted that the controller 100 may execute the following process when it is determined in S102 that the first sheet feed tray 21A is located at the detached position (S102: NO).

For example, the controller 100 may store the remaining sheet amount PN1 of the first sheet feed tray 21A, which is stored in the third memory 104C of the EEPROM 104 immediately before the printing system 1 was powered off, in the first memory 104A as the remaining sheet amount PA1. Alternatively, the controller 100 may store zero (0) as the remaining sheet amount of the first sheet feed tray 21A in the first memory 104A.

When it is determined that the first sheet feed tray 21A is located at the attached position (S102: YES), the controller 100 calculates the remaining sheet amount PN1 in the first sheet feed tray 21A based on the signal output by the first remainder sensor 66A (S103). Then, the controller 100 stores the remaining sheet amount PN1 of the first sheet feed tray 21A calculated in S102 in the third memory 104C (S104).

Next, the controller 100 determines whether the second sheet feed tray 21B is located at the attached position based on the signal output by the second tray sensor 65B (S105).

When it is determined that the first sheet feed tray 21B is located at the detached position (S105: NO), the controller 100 repeats executing S105 until the second tray sensor 65B outputs the signal indicating that the second sheet feed tray 21B is located at the attached position (i.e., until the user attaches the second sheet feed tray 21B to the printing system 1).

It is noted that the controller 100 may execute the following process when it is determined in S105 that the second sheet feed tray 21B is located at the detached position (S105: NO).

For example, the controller 100 may store the remaining sheet amount PN2 of the second sheet feed tray 21B, which is stored in the fourth memory 104D of the EEPROM 104 immediately before the printing system 1 was powered off, in the second memory 104B as the remaining sheet amount PA2. Alternatively, the controller 100 may store zero (0) as the remaining sheet amount of the second sheet feed tray 21B in the first memory 104B.

When it is determined that the second sheet feed tray 21B is located at the attached position (S105: YES), the controller 100 calculates the remaining sheet amount PN2 in the second sheet feed tray 21B based on the signal output by the second remainder sensor 66B (S106). Then, the controller 100 stores the remaining sheet amount PN2 of the second sheet feed tray 21B calculated in S106 in the third memory 104C (S107). Thereafter, the controller 100 terminates the present process.

<Operation when Sheet Feed Tray is Attached>

Next, a process when the user withdraws (detaches) the first sheet feed tray 21A or the second sheet feed tray 21B from the printing system 1, and then attaches the same to the printing system 1 will be described referring to FIG. 6.

Figure 6:
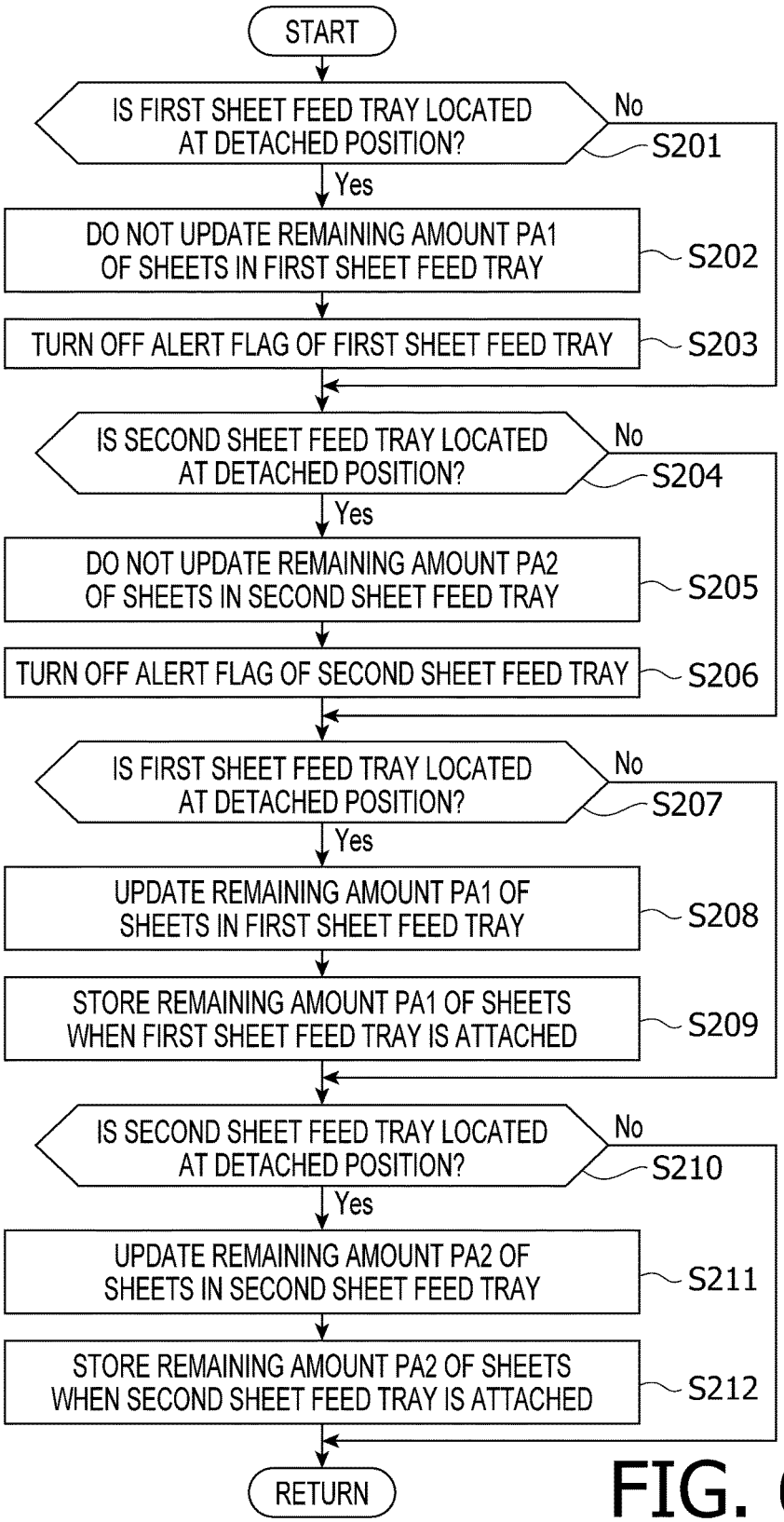
FIG. 6 is a flowchart illustrating a process executed by the controller of the printing system according to the first illustrative embodiment of the disclosures.

FIG. 6 shows a flowchart illustrating a process, which is executed by the controller 100. It is noted that the process shown by the flowchart in FIG. 6 (i.e., programs corresponding to respective steps of the process shown in FIG. 6) are stored, for example, in the ROM 102.

In the following description, the process shown in FIG. 6, which is executed by the controller 100, will be referred to as a remaining amount calculation process. It is noted that the controller 100 executes the remaining amount calculation process, and when the remaining amount calculation process is completed, the controller executes the remaining amount calculation process again, for example, 50 msec after the completion.

As shown in FIG. 6, the controller 100 determines whether the first sheet feed tray 21A is located at the detached position (S201) based on the signal output by the first tray sensor 65A. When it is determined that the first sheet feed tray 21A is located at the attached position (S201: NO), the controller executes S204. When it is determined that the first sheet feed tray 21A is located at the detached position (S201: YES), the controller may store zero (0) as the remaining sheet amount PA1 in the first sheet feed tray 21A in the first memory 104A.

When it is determined that the first sheet feed tray 21A is located at the detached position (S201: YES), the controller 100 does not update the remaining sheet amount PA1 stored in the first memory 104A (S202). Then, the controller 100 sets the alert flag of the first sheet feed tray 21A stored in the EEPROM 104 to "OFF" (S203) and executes S204.

In S204, the controller 100 determines whether the second sheet feed tray 21B is located at the detached position based on the signal output by the second tray sensor 65B. When it is determined that the second sheet feed tray 21B is located at the attached position (S204: NO), the controller executes S207.

When it is determined that the second sheet feed tray 21B is located at the detached position (S204: YES), the controller 100 may set zero (0), as the remaining sheet amount PA2 of the second sheet feed tray 21B, to the second memory 104B.

When it is determined that the second sheet feed tray 21B is located at the detached position (S204: YES), the controller 100 does not update the remaining sheet amount PA1 (S205), and sets "OFF" to the alert flag of the second sheet feed tray 21B (S206).

Next, the controller 100 determines whether the first sheet feed tray 21A is located at the attached position (S207) based on the signal output by the first tray sensor 65A. When it is determined that the first sheet feed tray 21A is located at the attached position (S207: YES), the controller 100 calculates the remaining sheet amount PA1 in the first sheet feed tray 21A when the first sheet feed tray 21A was attached to the printing system 1 based on the signal output by the first remainder sensor 66A (S208). This remaining sheet amount PA1 may also be referred to as an attached-time remaining sheet amount PA1 in the following description.

Thereafter, the controller 100 stores the remaining sheet amount PA1 in the first sheet feed tray 21A calculated in S208 in the first memory 104A (S209), and executes S210. Next, the controller 100 stores the remaining sheet amount PA1 calculated in S208 in the first memory 104A (S209), and proceeds to S210.

When it is determined that the first sheet feed tray 21A is located at the detached position (S207: NO), the controller 100 executes S210. In S210, the controller 100 determines whether the second sheet feed tray 21B is located at the attached position based on the signal output by the second tray sensor 65B.

When it is determined that the second sheet feed tray 21B is located at the attached position (S210: YES), the controller 100 calculates the remaining sheet amount PA2 in the second sheet feed tray 21B when the second sheet feed tray 21B was attached to the printing system 1 (S211) based on the signal output by the second remainder sensor 65B. This remaining sheet amount PA2 may also be referred to as an attached-time remaining sheet amount PA2 in the following description.

Next, the controller 100 stores the remaining sheet amount PA2 in the second sheet feed tray 21B calculated in S211 in the second memory 104B (S209), and terminates the remaining amount calculation process.

When it is determined that the second sheet feed tray 21B is not located in the attached position (S210: NO), the controller 100 terminates the remaining amount calculation process.

<Printing Operation of Printing System>

Figure 7A:
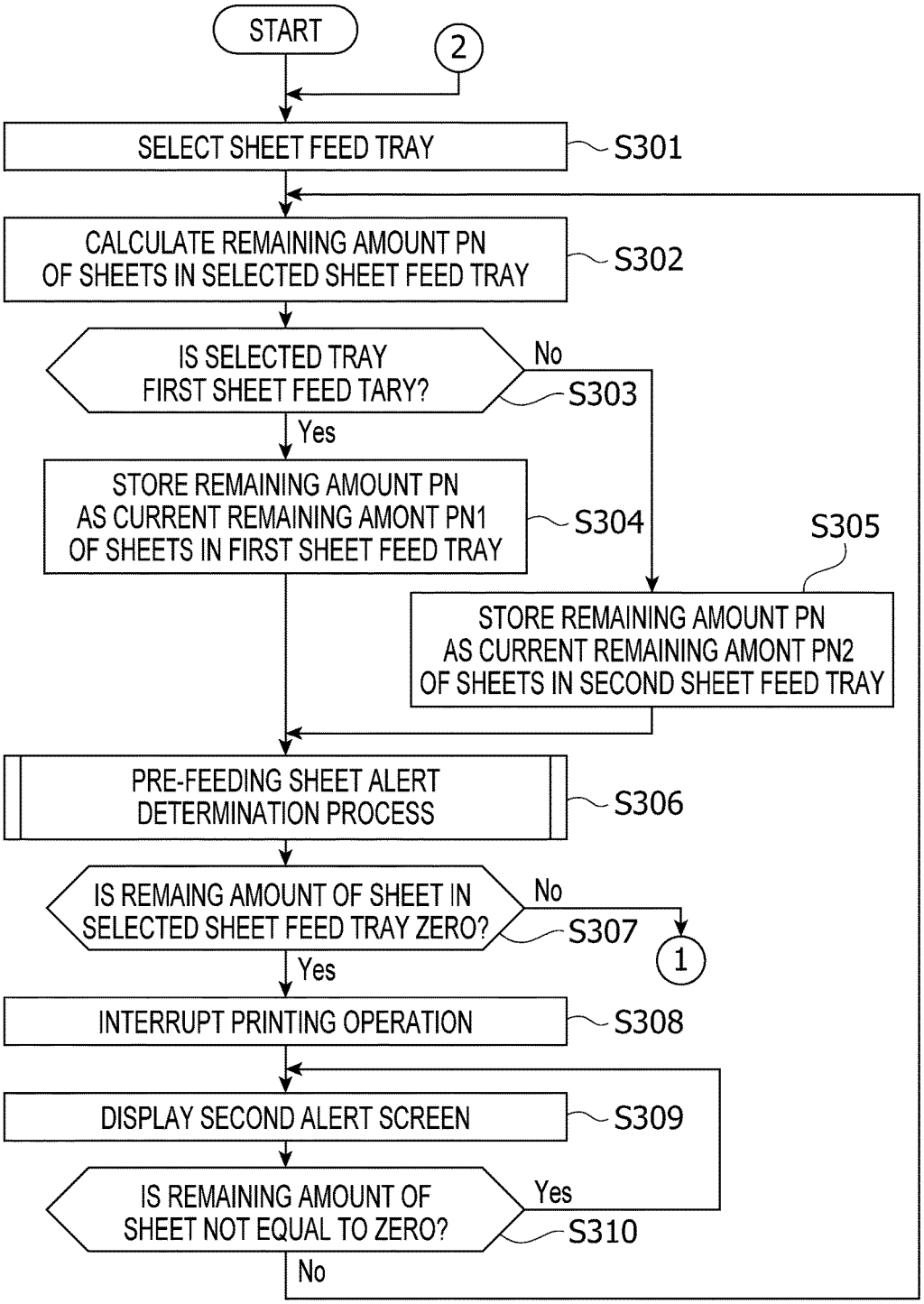
FIGS. 7A and 7B shows a flowchart illustrating a process executed by the controller of the printing system according to the first illustrative embodiment of the disclosures.
Figure 7B:
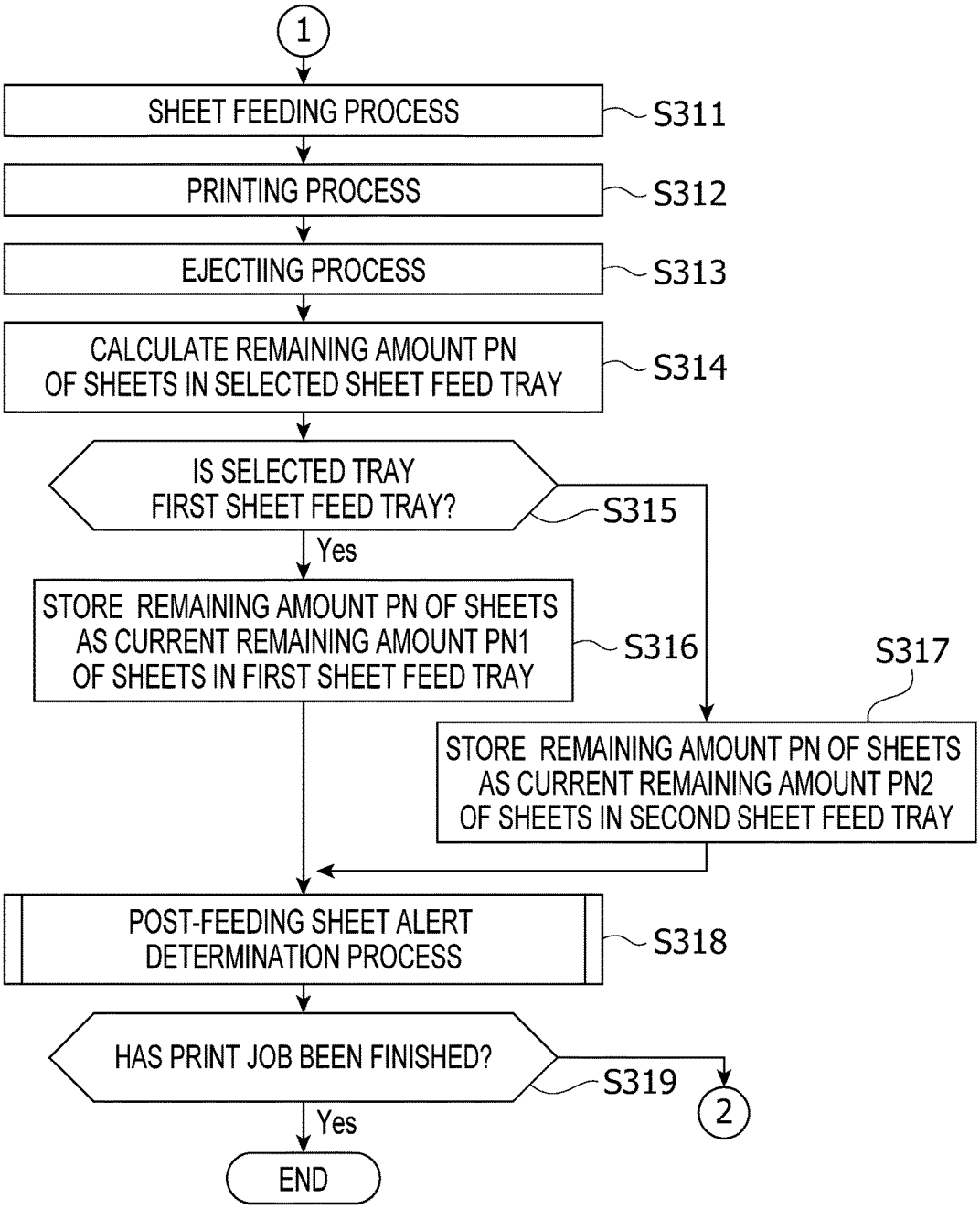

Next, a process executed by the controller 100 when a print job is received will be described referring to FIGS. 7A and 7B. It is noted that programs corresponding to the process shown in FIGS. 7A and 7B are stored, for example, in the ROM 102.

In the following description, the process shown in FIGS. 7A and 7B will be referred to as a print operation process. It is noted that the print operation process includes a plurality of processes such as a sheet feed process causing the sheet feeder 31 to feed the sheet 81, a printing process causing the printer 24 to print an image represented by the print job onto the sheet 81 fed by the sheet feeder 31, and the like.

It is noted that an operation described below are executed as the controller 100, which received the print job, retrieves a certain program from the ROM 102 and executes the retrieved program. As the controller 100 executes the program as described above, the controller 100 drives not-shown drivers and the like, thereby respective processes such as the printing process being executed.

For example, it is assumed that the controller 100 received a job corresponding to print data from the PC 300. Then, the controller 100 retrieves programs to execute respective steps of the flowchart shown in FIGS. 7A and 7B, and execute the programs. It is noted that the received job is stored, for example, in the RAM 103.

As shown in FIGS. 7A and 7B, the controller 100 selects a sheet feed tray accommodating the sheets, of which information including the sheet type information is stored in the EEPROM 104, corresponding to the information indicative of the sheet type included in the received job (i.e., the job stored in the RAM 103) (S301). Next, the controller 100 calculates the remaining sheet amount PN in the sheet feed tray selected in S301 based on the signal output by the remainder sensor corresponding to the sheet feed tray selected in S301 (S302). Thereafter, the controller 100 determines whether the sheet feed tray selected in S301 is the first sheet feed tray 21A (S303).

When it is determined that the sheet feed tray selected in S301 is the first sheet feed tray 21A (S301: YES), the controller 100 stores the remaining sheet amount PN calculated in S302 in the third memory 104C as the remaining sheet amount PN1 of the first sheet feed tray 21A (S304). This remaining sheet amount PN1 may also be referred to as a current remaining sheet amount PN1 in the following description.

When it is determined that the sheet feed tray selected in S301 is not the first sheet feed tray 21A (S301: NO), the controller 100 stores the remaining sheet amount PN calculated in S302 in the fourth memory 104D as the remaining sheet amount PN2 of the second sheet feed tray 21B (S305). This remaining sheet amount PN2 may also be referred to as a current remaining sheet amount PN2 in the following description.

Next, the controller 100 executes a pre-feeding sheet alert determination process (S306). The pre-feeding sheet alert determination process will be described later.

After execution of S306, the controller 100 determines whether the remaining sheet amount in the sheet feed tray selected in S301 is zero based on the signal output by the remaining sheet amount sensor of the sheet feed tray selected in S301 (S307).

When it is determined that the remaining sheet amount of the sheet feed tray selected in S301 is zero based on the signal output by the remainder sheet sensor (S307: YES), the controller 100 terminates the print operation process (S308), and displays a second alert screen 6 which is an example of an alert to be displayed on the remaining sheet amount is zero on the display 12 (S309). It is noted that the controller may display the second alert screen 5 on the PC display 302.

Next, referring to FIGS. 8A and 8B, a second alert screen 6 will be described.

Figure 8A:
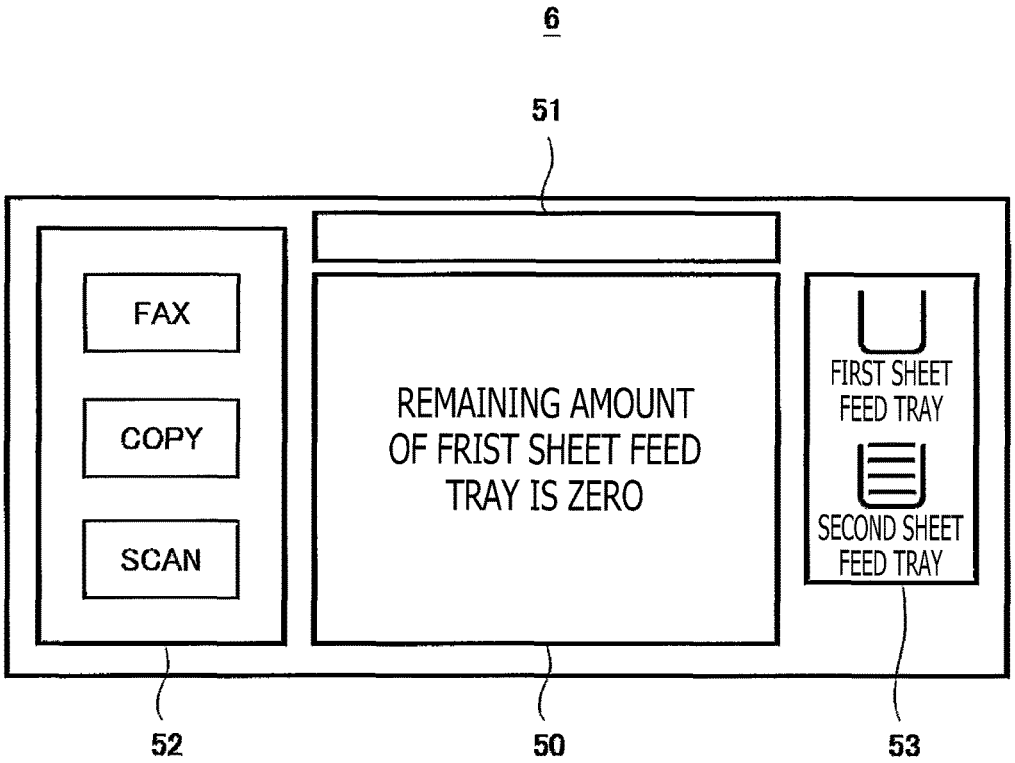
FIG. 8A shows an example of a second alarm screen displayed on the display of the printing system according to the first illustrative embodiment of the disclosures.
Figure 8B:
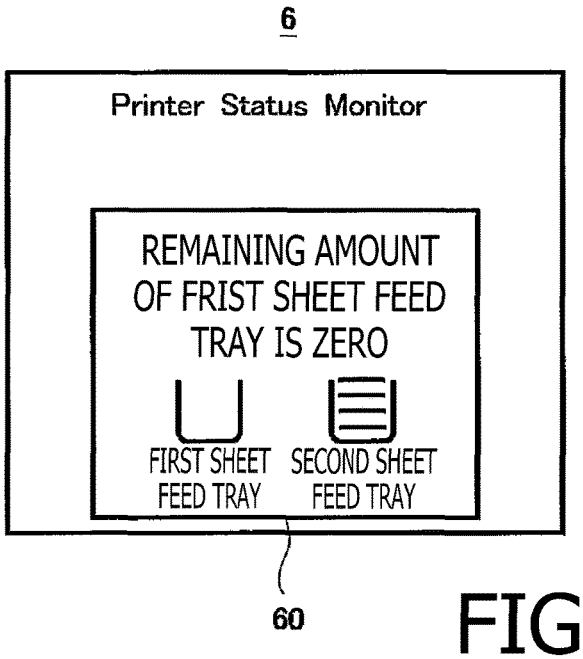
FIG. 8B shows an example of a second alarm screen displayed on a PC display of a PC according to the first illustrative embodiment of the disclosures.

FIG. 8A schematically shows an example of the second alert screen displayed on the display 12, and FIG. 8B schematically shows an example of the second alert screen 6 displayed on the PC display 302. In the examples shown in FIGS. 8A and 8B, the second alert screens 6 when the remaining sheet amount of the first sheet feed tray 21A becomes zero are shown as an example.

As show in FIG. 8A, the second alert screen 6 may be configured by an image displayed in the main image area 50 and showing characters indicating that "Remaining Amount of First Sheet Feed Tray is Zero." Alternatively, as shown in FIG. 8B, an image including the characters indicating that "Remaining Amount of First Sheet Feed Tray is Zero" and pictures (icons) showing that the remaining sheet amount in the first sheet feed tray 21A is zero may be displayed within the main screen area 60. Further alternatively, the second alert screen 6 may be composed of an image showing that there is no sheet in the first sheet feed tray 21A.

With the above configuration, the user can recognize that the number of the sheet 81 in the first sheet feed tray 21A is zero, thereby the user being implied to refill the sheets 81 in the first sheet feed tray 21A.

Thereafter, the controller determines whether the sheets 81 are refilled to the sheet feed tray (i.e., whether the remaining sheet amount is still zero or not) of which remaining amount becomes zero (S310). When it is determined that the remaining sheet amount is not zero (i.e., when it is determined that the there are sheets 81 in the sheet feed tray) (S310: YES), the controller 100 returns to S302.

When it is determined that the remaining sheet amount of the sheet feed tray selected in S301 is not zero based on the signal output by the remaining sheet amount sensor corresponding to the selected sheet feed tray (S307: NO), the controller 100 executes the sheet feed process (S311). That is, the controller 100 controls a not-shown driver to operate the sheet feeder 31 so that the sheet 81 is fed from the sheet feed tray selected in S301. Then, the sheet 81 in the sheet feed tray is fed to the sheet conveyance passage 25 by the sheet feeder 31. The sheet 81 supplied to the sheet conveyance passage 25 is conveyed to the conveyance roller pair 32 by the sheet feeder 31.

Next, the controller 100 executes the printing process (S312). Specifically, the controller 100 controls a not-shown driver to operate the conveyance roller pair 32 for a particular period of time so that the conveying process is executed and the sheet 81 is fed by a particular length. Next, the controller 100 controls a not-shown driver to operate the carriage motor (not shown) to move the carriage 41 in the main scanning direction. While the carriage 41 is being moved, the controller 100 controls the printing print head 42 of the printer 24, through a not-shown driver, to executes an ink ejecting process to eject the ink droplets.

As described above, the controller 100 repeatedly executes the conveying process and the ink ejecting process, thereby an image being printed on the sheet 81. In the following description, the repeatedly executed conveying process and the ink ejecting process by the controller 100 will be referred to as the printing process.

Thereafter, the controller 100 executes a discharging process (S313). Specifically, the controller 100 operates the conveyance roller pair 32 and the discharge roller pair 33 through a not-shown driver to discharge the sheet 81 onto the discharge tray 22.

Next, the controller 100 calculates the remaining sheet amount PN in the sheet feed tray selected in S301 based on the signal output by the remainder sensor corresponding to the sheet feed tray selected in S301 (S314). Next, the controller 100 determines whether the sheet feed tray selected in S301 is the first sheet feed tray 21A (S315).

When it is determined that the sheet feed tray selected in S301 is the first sheet feed tray 21A (S315: YES), the controller 100 stores the remaining sheet amount PN calculated in S314 in the third memory 104C as the current remaining sheet amount PN1 of the first sheet feed tray 21A.

When it is determined that the sheet feed tray selected in S301 is not the first sheet feed tray 21A (S315: NO), the controller 100 stores the remaining sheet amount PN calculated in S314 in the fourth memory 104D as the current remaining sheet amount PN2 of the second sheet feed tray 21A.

Next, the controller 100 executes a post-feeding sheet alert determination process (S318). Then, the controller 100 determines whether the print job has been finished, that is, whether there remains a print job which has not been executed (S319) after execution of S318.

When it is determined that the job has not been finished (S319: NO), the controller 100 returns to S301. When it is determined that the job has been finished (S319: YES), the controller 100 terminates the print operation process. It is noted that the post-feeding sheet alert determination process will be described later.

According to the first illustrative embodiment, the pre-feeding sheet alert determination process executed in S306 (FIG. 7A) and the post-feeding sheet alert determination process executed in S318 (FIG. 7B) are the same process, and will be simply referred to a sheet alert determination process hereinafter.

<Sheet Alert Determination Process>

Figure 9:
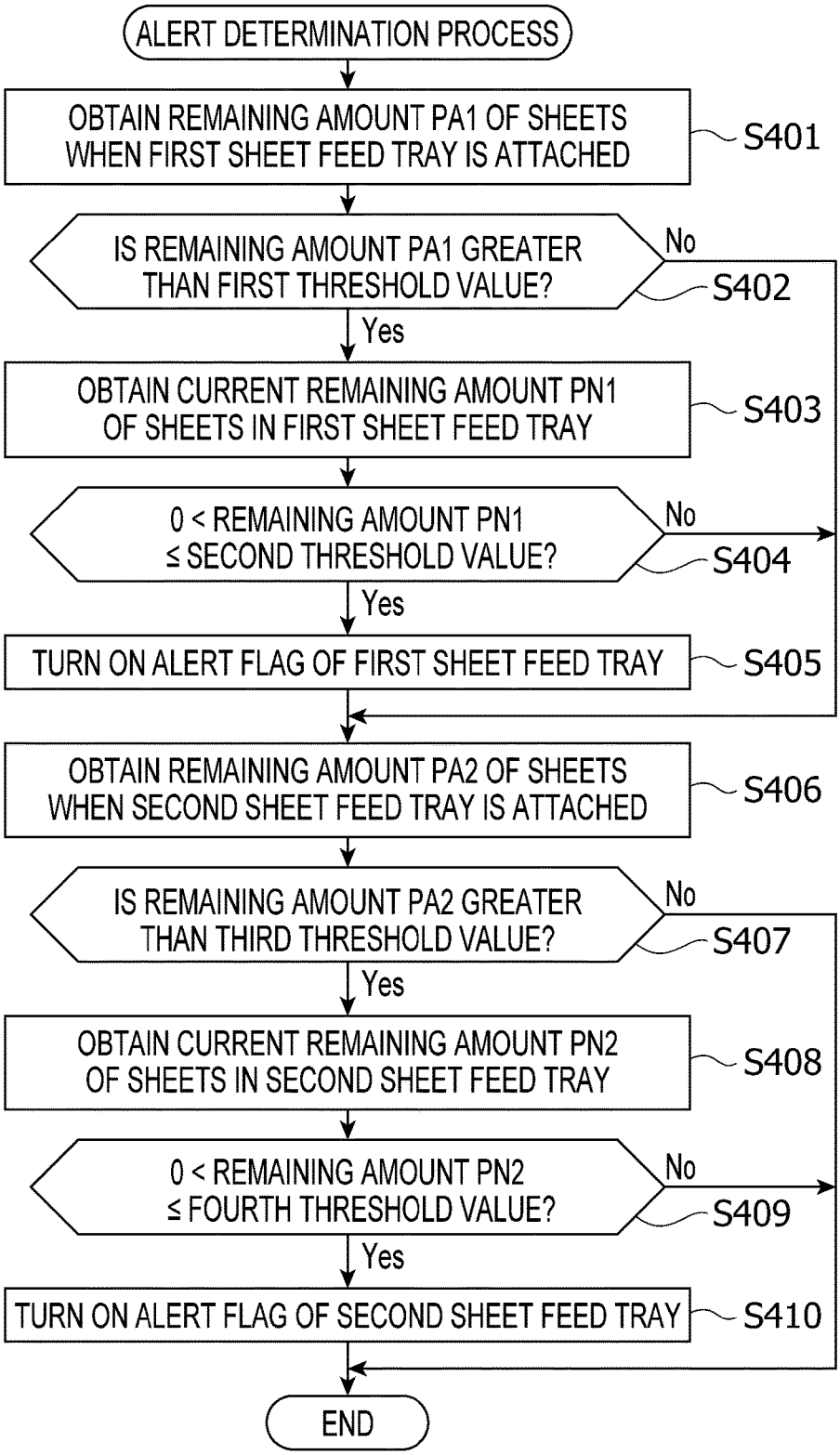
FIG. 9 is a flowchart illustrating a sheet alert determination process called in the process shown in FIGS. 7A and 7B.

Hereinafter, the sheet alert determination process called in the print operation process shown in FIGS. 7A and 7B will be described referring to a flowchart shown in FIG. 9. It is noted that programs corresponding to the process shown in FIG. 9 are stored, for example, in the ROM 102.

Firstly, the controller 100 obtains the remaining sheet amount PA1 of the first sheet feed tray 21A when the first sheet feed tray 21A has been attached to the printing system 1 from the first memory 104A (S401).

Next, the controller 100 determines whether the remaining sheet amount PA1 obtained in S401 is greater than a first threshold value (S402). It is noted that the first threshold value has been determined in advance. The first threshold value may be, for example, an arbitrary amount within 10%-17% of the maximum amount of the sheets 18 which can be accommodated in the first sheet feed tray, or arbitrary number within a range of 20 sheets-45 sheets.

When the first remainder sensor 66A is configured to detect the remaining amount of the sheets by the height of the sheets accommodated in the first sheet tray 21A stepwise (e.g., four steps), the threshold value may be the step corresponding to the smallest number of the sheets the first remainder sensor 66A detects (except for zero). It is noted that the first threshold value is used to notify the user that the remaining amount of the sheets 81 in the first sheet feed tray is in "near empty state" or the running-out of the sheets 81 will occur soon.

When it is determined that the remaining sheet amount PA1 obtained in S401 is greater than the first threshold value (S402: YES), the controller 100 obtains the currently stored remaining sheet amount PN1 of the first sheet feed tray 21A from the third memory 104C (S403).

Then, the controller 100 determines whether the remaining sheet amount PN1 obtained in S403 is greater than zero and less than a second threshold value (S404).

It is noted that the second threshold value has been determined in advance. The second threshold value may be, for example, an arbitrary amount within 10%-17% of the maximum amount of the sheets 81 which can be accommodated in the first sheet feed tray, or arbitrary number within a range of 20 sheets-45 sheets.

When the first remainder sensor 66A is configured to detect the remaining amount of the sheets by the height of the sheets accommodated in the first sheet tray 66A stepwise (e.g., four steps), the second threshold value may be the step corresponding to the smallest number of the sheets the first remainder sensor 66A detects (except for zero). The second threshold value may be set to be equal to or smaller than the first threshold value. It is noted that the second threshold value is used, similarly to the first threshold value, to notify the user that the remaining amount of the sheets 81 in the first sheet feed tray is in "near empty state" or the running-out of the sheets 81 will occur soon.

When it is determined that the remaining sheet amount PN1 obtained in S403 is greater than zero and equal to or less than the second threshold value (S404: YES), the controller 100 sets the alert flag of the first sheet feed tray 21A stored in the EEPROM 104 to "ON" (S405), and executes S406.

Thus, the controller 100 will cause the display 12 to display the first alert screen in an updating process of the screen display described later. The reason why the alert flag of the first sheet feed tray 21A stored in the EEPROM 104 is set to "ON" in the above case (i.e., S402: YES; and S404: YES) is as follows.

A case where the controller 100 determines that decision in S402 is YES is a case where there are sufficient sheets 81 in the first sheet feed tray 21A when the first sheet feed tray 21A has been attached to the printing system 1. Further, a case where the controller 100 determines that decision in S404 is YES is a case where the print operation process has been executed and the remaining sheet amount in the first sheet feed tray 21A becomes equal to the second threshold value or less, that is, the remaining sheets 81 in the first sheet feed tray 21A is in near empty state.

Therefore, by notifying the user that the sheets 81 sufficiently accommodated in the first sheet feed tray 21A have been consumed and the remaining amount is decreased, the user is implied to refill the sheets 81 in the first sheet feed tray 21A.

When it is determined that the remaining sheet amount PA1 obtained in S401 is equal to or less than the first threshold value (S402: NO), the controller 100 executes S406. That is, when it is determined that the remaining sheet amount PA1 obtained in S401 is equal to or less than the first threshold value (S402: NO), the controller 100 does not execute S405, and therefore, the alert flag of the first sheet feed tray 21A is not set to "ON."

According to the above-described configuration, the controller 100 does not display the first alert screen, which is an example of an alert indicating that the remaining sheet amount is equal to or less than the first threshold (i.e., the remaining sheets 81 are in the near-empty state), on the display 12. The reason why the alert flag of the first sheet feed tray 21A is not set to "ON" in the above case (i.e., S402: NO) is explained below.

A case where the decision in S402 is "NO" is a case where the amount of the sheets 81 in the first sheet feed tray 21A when the first sheet feed tray 21A has been attached to the print system 1 is relatively small. In such a case, since the user recognizes that the remaining sheet amount is relatively small, the alert regarding the remaining sheet amount is bothersome to the user. Therefore, in the print system 1 according to the first illustrative embodiment, when it is determined that the remaining sheet amount PA1 of the first sheet feed tray 21A when the first sheet feed tray 21A has been attached to the print system 1 is equal to or less than the first threshold value, the alert flag of the first sheet feed tray 21A is not set to "ON."

Next, the controller 100 obtains the remaining sheet amount PA2 of the second sheet feed tray 21B when the second sheet feed tray 21B has been attached to the print system 1 from the second memory 104B (S406).

Next, the controller 100 determines whether the remaining sheet amount PA2 obtained in S406 is greater than a third threshold value (S407). It is noted that the third threshold value has been determined in advance. The third threshold value may be, for example, an arbitrary amount within 10%-17% of the maximum amount of the sheets 18 which can be accommodated in the first sheet feed tray, or arbitrary number within a range of 20 sheets-45 sheets.

When the second remainder sensor 66B is configured to detect the remaining amount of the sheets by the height of the sheets accommodated in the second sheet tray 21B stepwise (e.g., four steps), the third threshold value may be the step corresponding to the smallest number of the sheets 81 the second remainder sensor 66B detects (except for zero). It is noted that the third threshold value is used to notify the user that the remaining amount of the sheets 81 in the second sheet feed tray is in the "near empty state" or the running-out of the sheets 81 will occur soon.

When it is determined that the remaining sheet amount PA2 obtained in S406 is greater than the third threshold value (S407: YES), the controller 100 obtains the currently stored remaining sheet amount PN2 of the second sheet feed tray 21B from the fourth memory 104D (S408).

Then, the controller 100 determines whether the remaining sheet amount PN2 obtained in S408 is greater than zero and less than a fourth threshold value (S409).

It is noted that the fourth threshold value has been determined in advance. The fourth threshold value may be, for example, an arbitrary amount within 10%-17% of the maximum amount of the sheets 81 which can be accommodated in the second sheet feed tray, or arbitrary number within a range of 20 sheets-45 sheets.

When the second remainder sensor 66B is configured to detect the remaining amount of the sheets 81 by the height of the sheets 81 accommodated in the second sheet tray 66B stepwise (e.g., four steps), the fourth threshold value may be the step corresponding to the smallest number of the sheets 81 the second remainder sensor 66B detects (except for zero). The fourth threshold value may be set to be equal to or smaller than the third threshold value. It is noted that the fourth threshold value is used, similarly to the third threshold value, to notify the user that the remaining amount of the sheets 81 in the second sheet feed tray is in the "near empty state" or the running-out of the sheets 81 will occur soon.

When it is determined that the remaining sheet amount PN2 obtained in S408 is greater than zero and equal to or less than the fourth threshold value (S409: YES), the controller 100 sets the alert flag of the second sheet feed tray 21B stored in the EEPROM 104 to "ON" (S410), and terminates the sheet alert determination process.

Thus, the controller 100 will cause the display 12 to display the first alert screen in the updating process of the screen display described later. The reason why the alert flag of the second sheet feed tray 21B stored in the EEPROM 104 is set to "ON" in the above case (i.e., S407: YES; and S409: YES) is as follows.

A case where the controller 100 determines that decision in S407 is YES is a case where there are sufficient sheets 81 in the second sheet feed tray 21B when the second sheet feed tray 21B has been attached to the printing system 1. Further, a case where the controller 100 determines that decision in S409 is YES is a case where the print operation process has been executed and the remaining sheet amount in the second sheet feed tray 21B becomes equal to the fourth threshold value or less, that is, the remaining sheets 81 in the second sheet feed tray 21B is in the near empty state.

Therefore, by notifying the user that the sheets 81 sufficiently accommodated in the second sheet feed tray 21B have been consumed and the remaining amount is decreased, the user is implied to refill the sheets 81 in the second sheet feed tray 21B.

When it is determined that the remaining sheet amount PA2 obtained in S406 is equal to or less than the third threshold value (S407: NO), the controller 100 terminates the sheet alert determination process. That is, when it is determined that the remaining sheet amount PA2 obtained in S406 is equal to or less than the third threshold value (S407: NO), the controller 100 does not execute S410, and therefore, the alert flag of the second sheet feed tray 21B is not set to "ON."

According to the above-described configuration, the alert process is not executed and the first alert screen is not displayed on the display 12. The reason why the alert flag of the second sheet feed tray 21B is not set to "ON" in such a case (i.e., S407: NO) is described below.

A case where the decision in S407 is "NO" is a case where the amount of the sheets 81 in the second sheet feed tray 21B when the second sheet feed tray 21B has been attached to the print system 1 is relatively small. In such a case, since the user recognizes that the remaining sheet amount is relatively small, the alert regarding the remaining sheet amount is bothersome to the user. Therefore, in the print system 1 according to the first illustrative embodiment, when it is determined that the remaining sheet amount PA2 of the second sheet feed tray 21B when the second sheet feed tray 21B has been attached to the print system 1 is equal to or less than the third threshold value, the alert flag of the second sheet feed tray 21B is not set to "ON."

<Screen Updating Process>

Next, a program the controller 100 executes to update the screen displayed on the display 12 of the printing system 1 according to the first illustrative embodiment will be described referring to FIG. 10. It is noted that a program corresponding to the process illustrated by the flowchart is stored, for example, in the ROM 102.

In the following description, the process shown in FIG. 10 and executed by the controller 100 will be referred to as a screen updating process. It is noted that the controller 100 is configured to execute the screen updating process. After completion of the screen updating process, the controller 100 executes the screen updating process again, for example, after 50 msec has elapsed.

Figure 10:
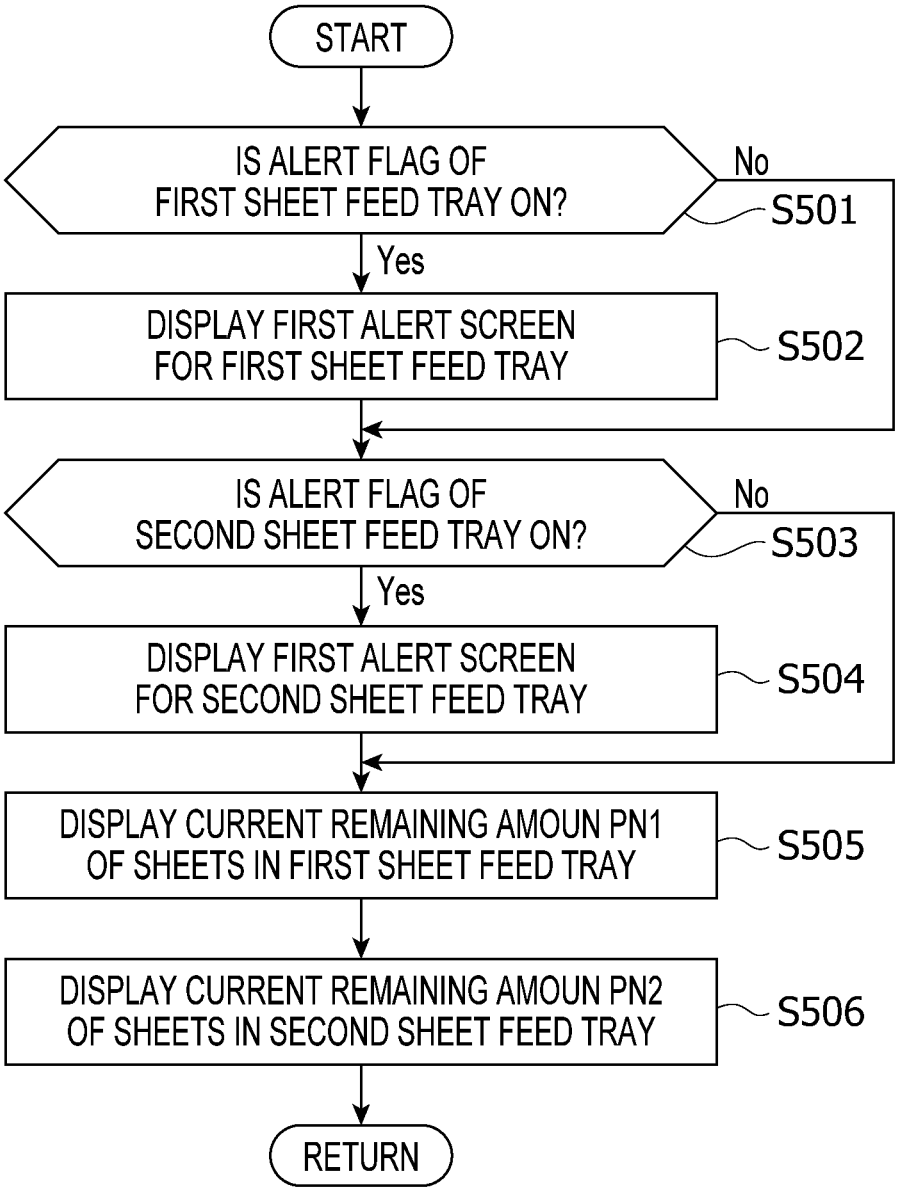
FIG. 10 is a flowchart illustrating a process executed by the controller of the printing system according to the first illustrative embodiment of the disclosures.

As shown in FIG. 10, the controller 100 determines whether the alert flag of the first sheet feed tray 21A stored in the EEPROM 104 is "ON" (S501). When it is determined that the alert flag of the first sheet feed tray 21A stored in the EEPROM 104 is "ON" (S501: YES), the controller 100 causes the display 12 to display the first alert screen regarding the first sheet feed tray 21A (S502). It is noted that the controller 100 may be configured to display the first alert screen on the PC display 302.

Figure 11A:
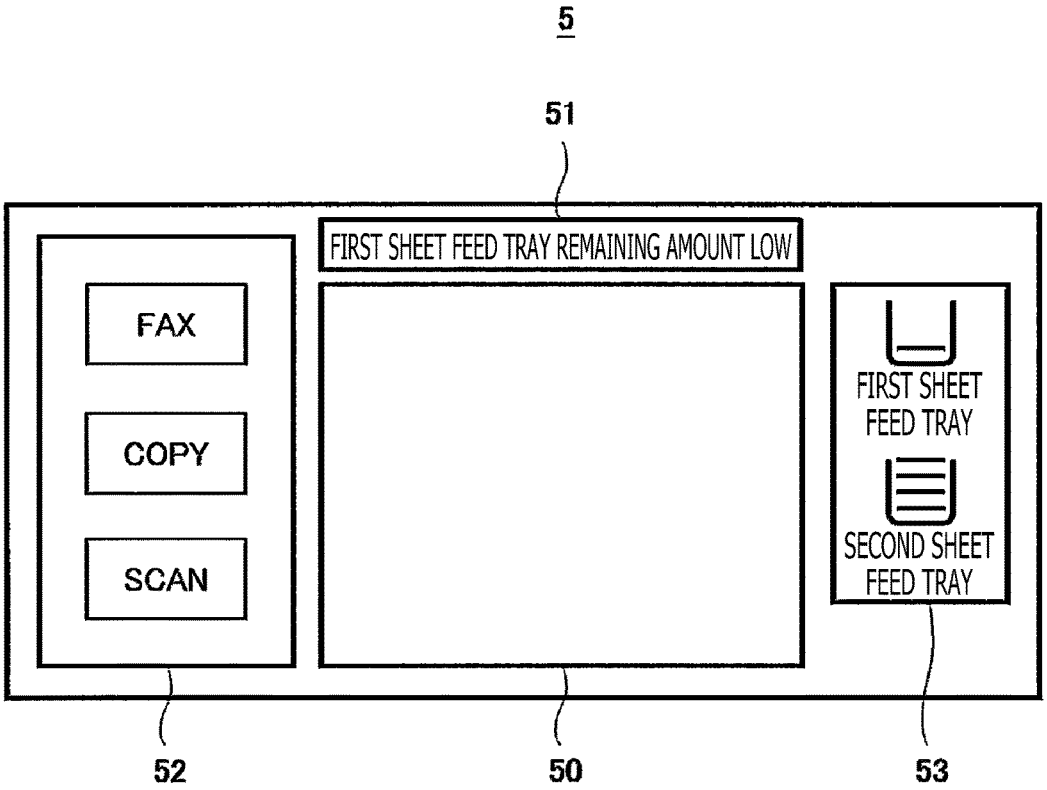
FIG. 11A shows an example of a first alarm screen displayed on the display of the printing system according to the first illustrative embodiment of the disclosures.
Figure 11B:
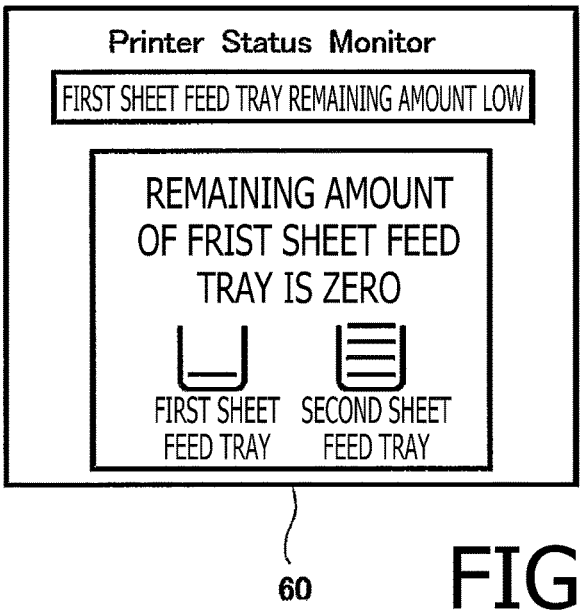
FIG. 11B shows an example of a first alarm screen displayed on the PC display of a PC according to the first illustrative embodiment of the disclosures.

Next, referring to FIGS. 11A and 11B, the first alert screen will be described. FIG. 11A. FIG. 11A schematically shows an example of the first alert screen displayed on the display 12, and FIG. 11B schematically shows an example of the first alert screen displayed on the PC display 302.

As shown in FIG. 11A, the first alert screen may be configured to display a screen including a character string "First Sheet Feed Tray Remaining Amount Low" on the sub image area 51 of the standby screen 5. Further, as shown in FIG. 11B, the first alert screen may include a character string "First Sheet Feed Tray Remaining Amount Low" displayed in the main screen area 60.

With the above configuration, the user can recognize that the number of the sheet 81 in the first sheet feed tray 21A is equal to or less than the first threshold value (i.e., the remaining amount of the sheets 81 is small or will become zero soon), thereby the user being implied to refill the sheets 81 in the first sheet feed tray 21A.

Next, the controller 100 determines whether the alert flag of the second sheet feed tray 21B stored in the EEPROM 104 is "ON" or not (S503). When it is determined that the alert flag of the second sheet feed tray 21B stored in the EEPROM 104 is ON (S503: YES), the controller 100 causes the display 12 to display the first alert screen regarding the second sheet feed tray 21B (S504). It is noted that the controller 100 may cause the PC display 302 to display the first alert screen.

Then, the controller 100 obtains the remaining sheet amount PN1 in the first sheet feed tray 21A from the third memory 104C, and displays the obtained remaining sheet amount PN1 of the sheets 81 on the display 12 (S505). Specifically, as shown in FIG. 11A, the controller displays a picture indicating the remaining sheet amount in the first sheet feed tray 21A in the remaining sheet amount display area 53.

It is noted that the controller 100 may be configured to display the remaining sheet amount PN1 on the PC display 302. For example, as shown in FIG. 11B, the controller 100 may be configured to display an image (i.e., a remaining amount display image) showing a picture indicating the remaining sheet amount of the first sheet feed tray 21A in the main screen area 60.

Then, the controller 100 obtains the remaining sheet amount PN2 of the first sheet feed tray 21B from the fourth memory 104D, and causes the display 12 to display the remaining sheet amount PN2 (S506). For example, as shown in FIG. 11A, the controller 100 may be configured to display the picture indicating the remaining sheet amount of the second sheet feed tray 21B in the remaining sheet amount display area 53 of the standby screen 5.

It is noted that the controller 100 may be configured to display the remaining sheet amount PN2 on the PC display 302. For example, as shown in FIG. 11B, the controller 100 may be configured to display an image (i.e., a remaining amount display image) showing a picture indicating the remaining sheet amount of the second sheet feed tray 21B in the main screen area 60.

Thus, in the printing system 1 according to the first illustrative embodiment, when the sheet feed tray has been attached to the printing system 1, even if the remaining sheet amount is equal to or less than the first threshold value, the first alert screen is not displayed on the display 12.

In other words, in the printing system 1 according to the first illustrative embodiment, when the user recognizes that the remaining sheet amount in the sheet feed tray is small, the first alert screen is not displayed. Therefore, in comparison with a case where such an alert screen is displayed regardless the user recognizes the remaining sheets in the sheet feed tray is in the near-empty state, the user will not be bothered by such an alert screen.

Further, according to the first embodiment, when the remaining sheet amount at a time when the sheet feed tray has been attached to the printing system 1 is greater than the first threshold value, and the remaining sheet amount decreases and becomes equal to or less than the first threshold value as the print operation process proceeds, the first alert screen is displayed.

Accordingly, the user can recognize that the remaining sheet amount in the sheet feed tray becomes equal to or less than the first threshold value, thereby the user being implied to refill the sheets 81 to the sheet feed tray.

As above, according to the first illustrative embodiment, the alert regarding the remaining amount of the sheets 81 is notified when necessary, while such an alert is not notified when unnecessary. Therefore, usability of the printing system 1 is improved.

Second Embodiment

Operation of Printing System

<Post-Feeding Sheet Alert Determination Process>

Figure 12:
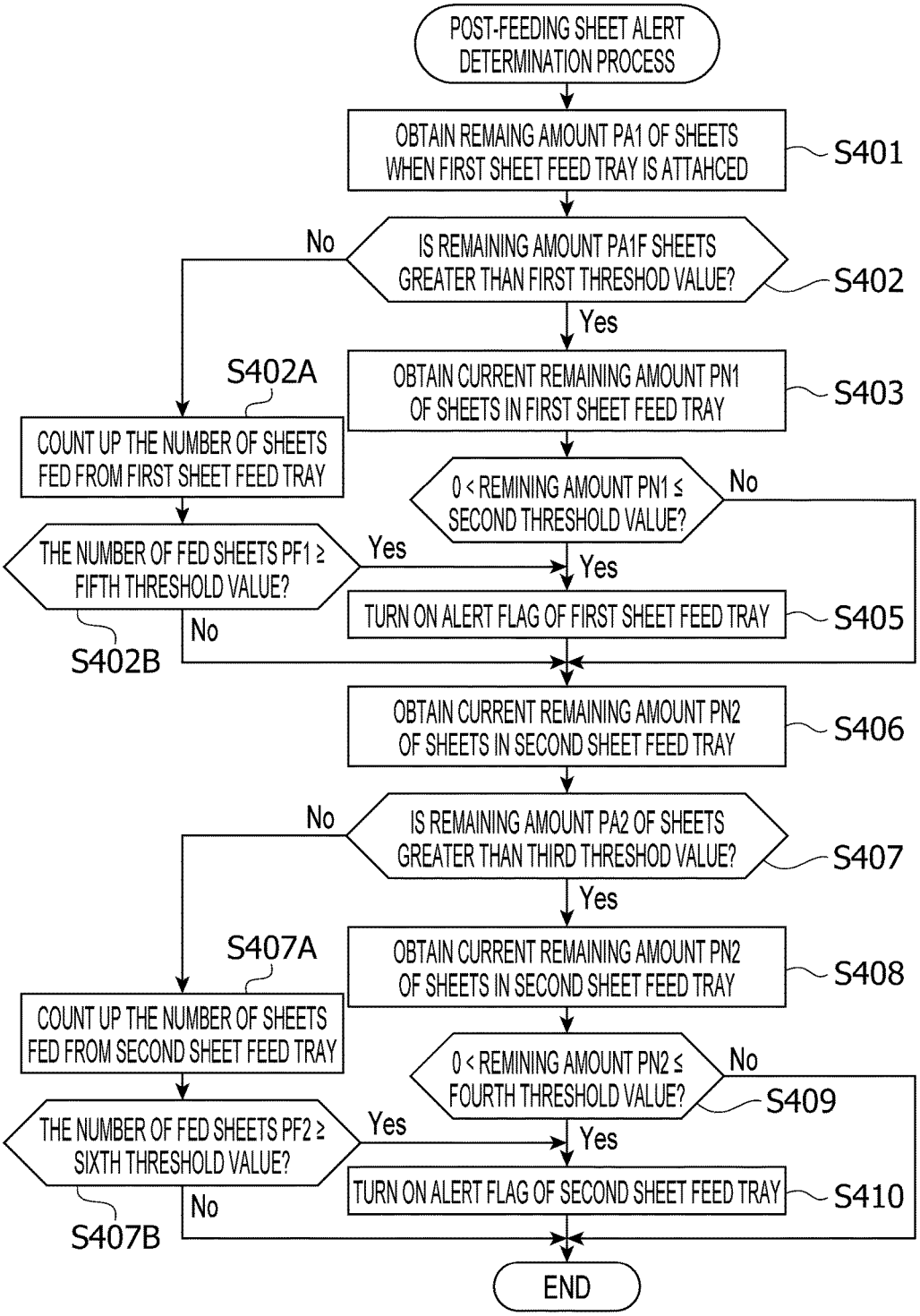
FIG. 12 is a flowchart illustrating a process executed by the controller of the printing system according to a second illustrative embodiment of the disclosures.

FIG. 12 shows a flowchart illustrating a process executed by the controller 100 according to a second illustrative embodiment. It is noted that the hardware configuration of the printing system 1 according to the second illustrative embodiment is the same as that of the first illustrative embodiment, and description of the hardware configuration will be omitted. Programs which are executed by the controller 100 to realize the process shown in FIG. 12 are stored, for example, in the ROM 102.

It is noted that an operation of the printing system 1 according to the second illustrative embodiment is substantially similar to that of the first illustrative embodiment except for the post-feeding sheet alert determination process. Hereinafter, referring to FIG. 12, the second illustrative embodiment will be described in detail.

As shown in FIG. 12, in the operation of the printing system 1 according to the second illustrative embodiment, when the decision in S402 is "NO," the controller 100 executes S402A and S402B.

Specifically, when it is determined that the remaining sheet amount PA1 obtained in S401 is equal to or less than 1 (S402: NO), the controller 100 causes the fifth memory 104E to count up the number PF1 of the sheets 81 supplied from the first sheet feed tray 21A.

Next, the controller 100 determines whether the number PF1 of the sheets 81 supplied from the first sheet feed tray 21A stored in the fifth memory 104E is equal to or greater than a fifth threshold value (S402B). The fifth threshold value has been determined in advance, and for example, the fifth threshold value may be an arbitrary value with an range from one to the first threshold value. Alternatively, the fifth threshold value may be an arbitrary value from two to ten in view of notifying another user who has attached the first sheet feed tray 21A to the printing system 1 that the remaining sheet amount in the first sheet feed tray 21A is equal to or less than the first threshold value. It is noted that the fifth threshold value is used to notify the user that the remaining amount of the sheets 81 in the first sheet feed tray 21A is in the "near empty state" or the running-out of the sheets 81 will occur soon.

When it is determined that the number PF1 of the supplied sheets 81 is equal to or greater than the fifth threshold value (S402B: YES), the controller 100 sets the alert flag of the first sheet feed tray 21A stored in the EEPROM 104 to "ON" (S405).

Thus, the controller 100 will cause the display 12 to display the first alert screen in the updating process of the screen display. For example, it is assumed that a certain user stores a relatively small amount of sheets 81 in the first sheet feed tray 21A and has attached the same to the printing system 1. In such a case, another user who intends to transmit a job to the printing system 1 does not recognize that the first sheet feed tray 21A accommodates only the small amount of sheets 81.

According to the second illustrative embodiment, as the controller 100 executes S402A and S402B, the controller 100 can notify the other user that the remaining sheet amount in the first sheet feed tray 21A is equal to or less than the first threshold value (i.e., the amount of the sheets 81 is relatively small, or running-out of the sheets 81 occurs soon) at an earlier timing in comparison with the printing system 1 according to the first illustrative embodiment.

In the printing system 1 according to the second illustrative embodiment, when decision at S407 is NO, S407A and S407B are executed.

That is, when it is determined that the remaining sheet amount PA2 obtained in S406 is equal to or less than three (S407: NO), the controller 100 causes a sixth memory 104F to count up the number PF2 of the sheets 81 supplied from the second sheet feed tray 21B (S407A).

Next, the controller 100 determines whether the number PF2 of the sheets 81 stored in the sixth memory 104F is equal to or greater than six (S407B). It is noted that the six threshold value has been determined in advance, and may be an arbitrary value from one to the third threshold value. Alternatively, the sixth threshold value may be an arbitrary value from two to ten in view of notifying another user who has attached the second sheet feed tray 21B to the printing system 1 that the remaining sheet amount in the second sheet feed tray 21B is equal to or less than the first threshold value. It is noted that the sixth threshold value is used to notify the user that the remaining amount of the sheets 81 in the second sheet feed tray 21B is in the "near empty state" or the running-out of the sheets 81 will occur soon.

When it is determined that the number PF2 of the supplied sheets 81 is equal to or greater than the sixth threshold value (S407B: YES), the controller 100 sets the alert flag of the second sheet feed tray 21B stored in the EEPROM 104 to "ON" (S408).

Thus, the controller 100 will cause the display 12 to display the first alert screen in the updating process of the screen display. For example, it is assumed that a certain user stores a relatively small amount of sheets 81 in the second sheet feed tray 21B and has attached the same to the printing system 1. In such a case, another user who intends to transmit a job to the printing system 1 does not recognize that the second sheet feed tray 21B accommodates only the small amount of sheets 81.

According to the second illustrative embodiment, as the controller 100 executes S407A and S407B, the controller 100 can notify the other user that the remaining sheet amount in the second sheet feed tray 21B is equal to or less than the first threshold value (i.e., the amount of the sheets 81 is relatively small, or running-out of the sheets 81 occurs soon) at an earlier timing in comparison with the printing system 1 according to the first illustrative embodiment.

<Operation when Sheet Feed Tray is Attached>

Figure 13A:
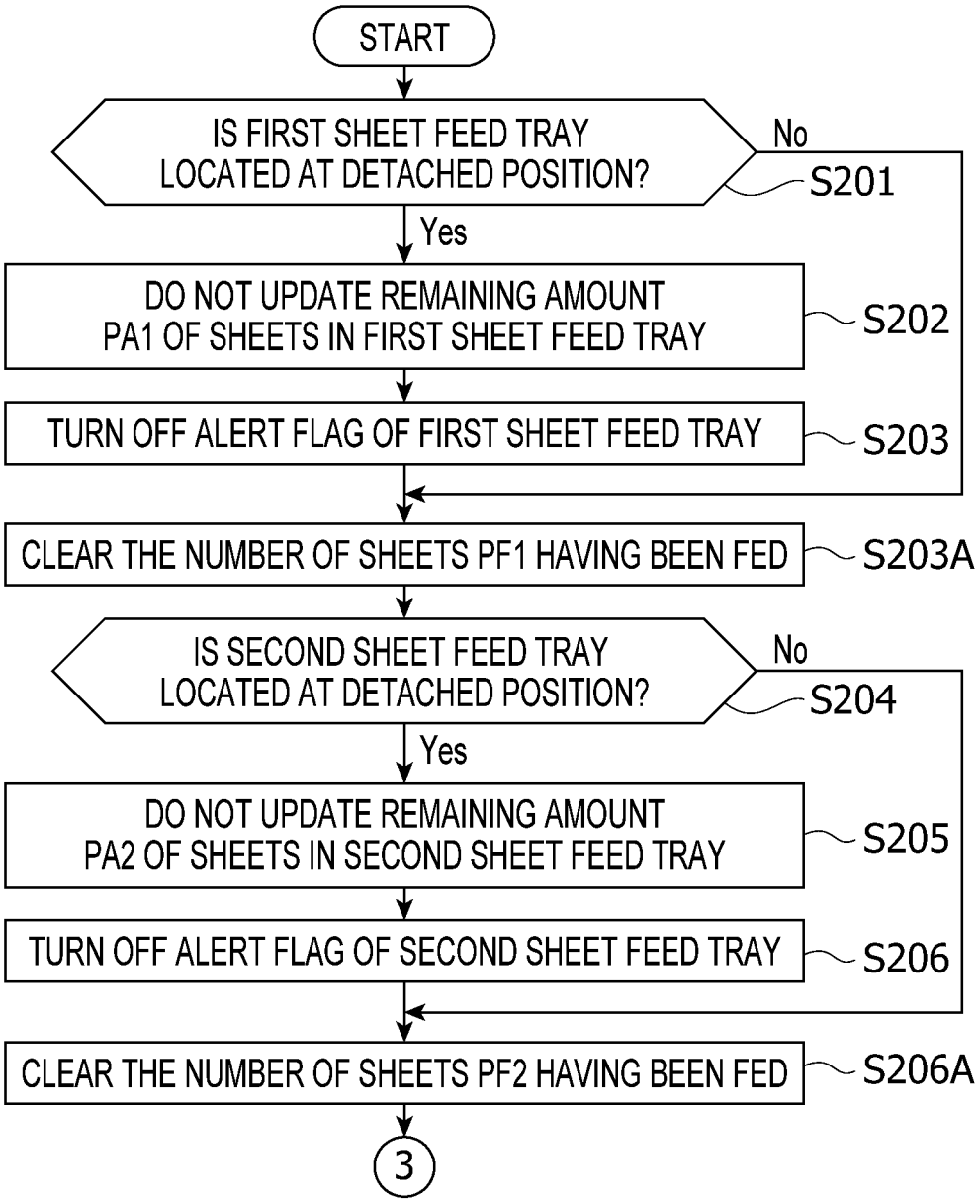
FIGS. 13A and 13B show a flowchart illustrating a process executed by the controller of the printing system according to the second illustrative embodiment of the disclosures.
Figure 13B:
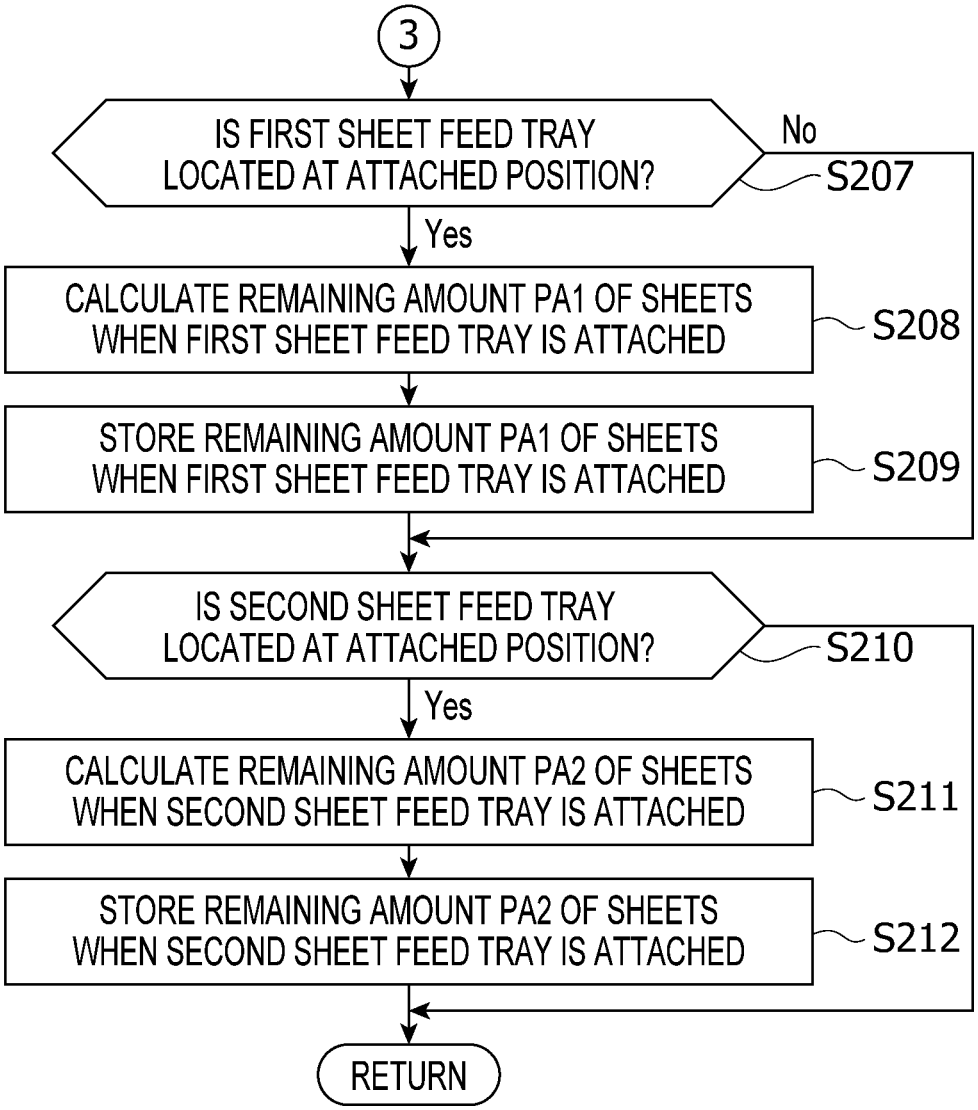

FIGS. 13A and 13B show a flowchart illustrating a process executed by the controller 100 according to the second illustrative embodiment. Programs which are executed by the controller 100 to realize the process shown in FIGS. 13A and 13B are stored, for example, in the ROM 102.

It is noted that an operation of the printing system 1 according to the second illustrative embodiment is substantially similar to that of the first illustrative embodiment except for the remaining amount calculation process when the sheet feed tray has been attached to the printing system 1. Hereinafter, referring to FIGS. 13A and 13B, the remaining amount calculation process according to the second illustrative embodiment will be described in detail.

As shown in FIGS. 13A and 13B, in the operation of the printing system 1 according to the second illustrative embodiment, the controller 100 executes S203A between S203 and S204.

Specifically, the controller 100 sets the alert flag of the first sheet feed tray 21A stored in the EEPROM 104 to "OFF" (S203), and clears the number PF1 of the supplied sheets 81 stored in the fifth memory 104E (i.e., sets the number PF1 to zero) (S203A).

According to the above process, when the first sheet feed tray 21A is removed from the printing system 1, the number of supplied sheets 81 is reset, and the number of the sheets 81 supplied from the first sheet feed tray 21A can be counted every time the first sheet feed tray 21A is attached to the printing system 1.

Further, as shown in FIGS. 13A and 13B, in the operation of the printing system 1 according to the second illustrative embodiment, the controller 100 executes S206A between S206 and S207.

Specifically, the controller 100 sets the alert flag of the second sheet feed tray 21B stored in the EEPROM 104 to "OFF" (S206), and clears the number PF2 of the supplied sheets 81 stored in the fifth memory 104E (i.e., sets the number PF2 to zero) (S206A).

According to the above process, when the second sheet feed tray 21B is removed from the printing system 1, the number of supplied sheets 81 is reset, and the number of the sheets 81 supplied from the second sheet feed tray 21B can be counted every time the second sheet feed tray 21B is attached to the printing system 1.

As above, usability is improved in the printing system 1 according to the second illustrative embodiment, as well as in printing system 1 according to the first illustrative embodiment.

In the printing system 1 according to the second illustrative embodiment, when the remaining sheet amount in the sheet feed tray is equal to or less than the first threshold value at the time when the sheet feed tray is attached to the printing system 1, the first alert screen is not displayed on the display 12. However, as the sheets 81 are fed from the sheet feed tray and the printing operation process is executed with respect to the sheets 81 of which number is equal to or greater than the threshold value, the first alert screen is displayed on the display 12.

Accordingly, the alert is not notified to the user who has attached the sheet feed tray to the printing system 1, while the other user will be notified that the remaining sheet amount is equal to or less than the first threshold vale (i.e., the remaining amount of the sheets 81 is small, or running-out of the sheets 81 will occur soon).

Third Embodiment

Operation of Printing System

<Printing Operation of Printing System>

Figure 14A:
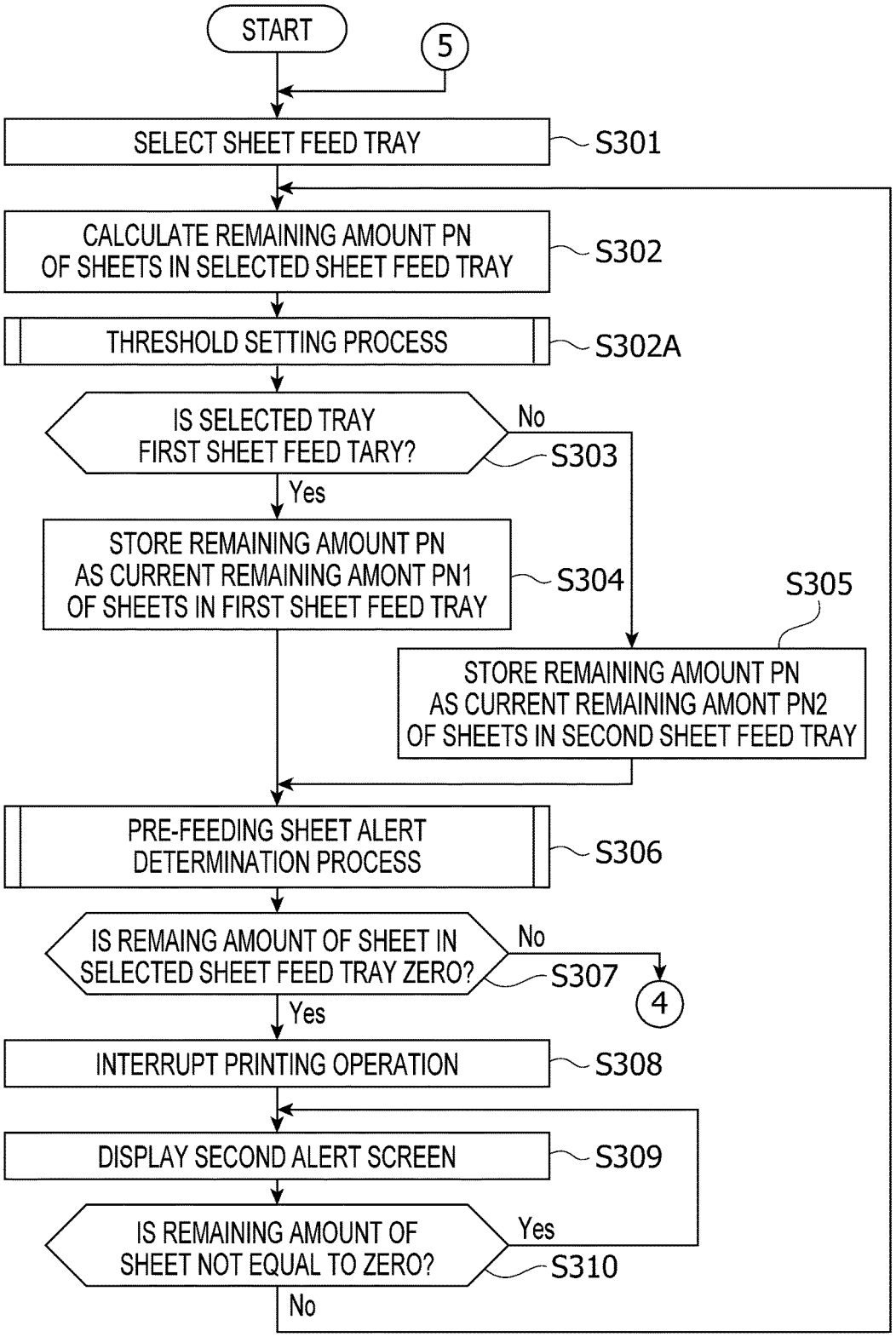
FIGS. 14A and 14B show a flowchart illustrating a process executed by the controller of the printing system according to a third illustrative embodiment of the disclosures.
Figure 14B:
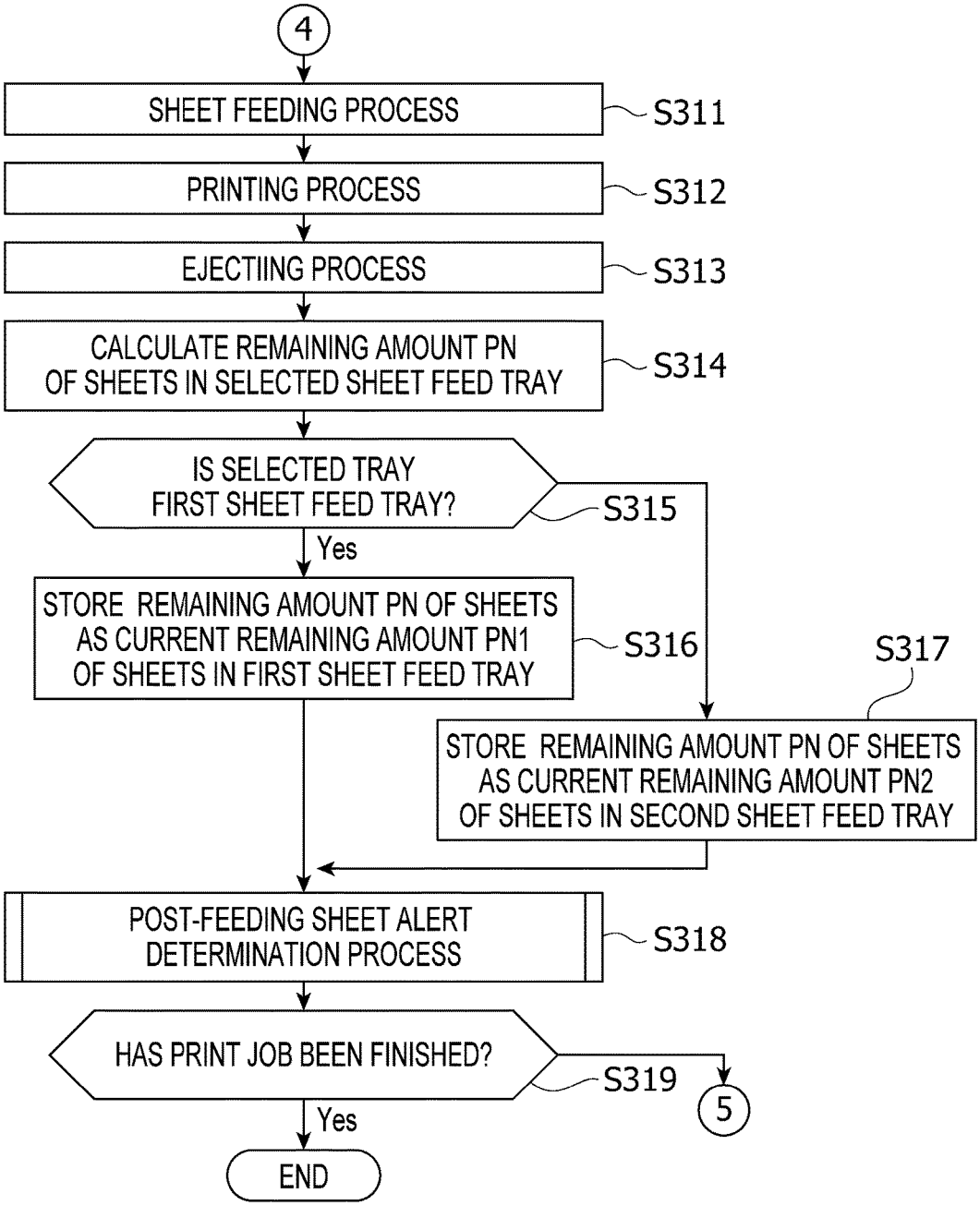

FIGS. 14A and 14B show a flowchart illustrating a process executed by the controller 100 according to a third illustrative embodiment. It is noted that programs which cause the controller 100 to execute the process shown in FIGS. 14A and 14B are stored, for example, in the ROM 102.

It is noted that an operation of the printing system 1 according to the third illustrative embodiment is substantially similar to that of the first illustrative embodiment except for the print operation process. Hereinafter, referring to FIGS. 14A and 14B, the third illustrative embodiment will be described in detail.

As shown in FIGS. 14A and 14B, in the printing system 1 according to the third illustrative embodiment, the controller 100 executes S302A between S302 and S303. Specifically, the controller 100 selects a sheet feed tray accommodating the sheets, of which information including the sheet type information is stored in the EEPROM 104, corresponding to the information indicative of the sheet type included in the received job (i.e., the job stored in the RAM 103) (S301) and executes a threshold setting process (S302A)

Next, referring to FIG. 15 which shows the threshold setting process called in the process shown in FIG. 14A, the threshold setting process will be described. It is noted that programs which cause the controller 100 to execute the process shown in FIG. 15 are stored, for example in the ROM 102.

Figure 15:
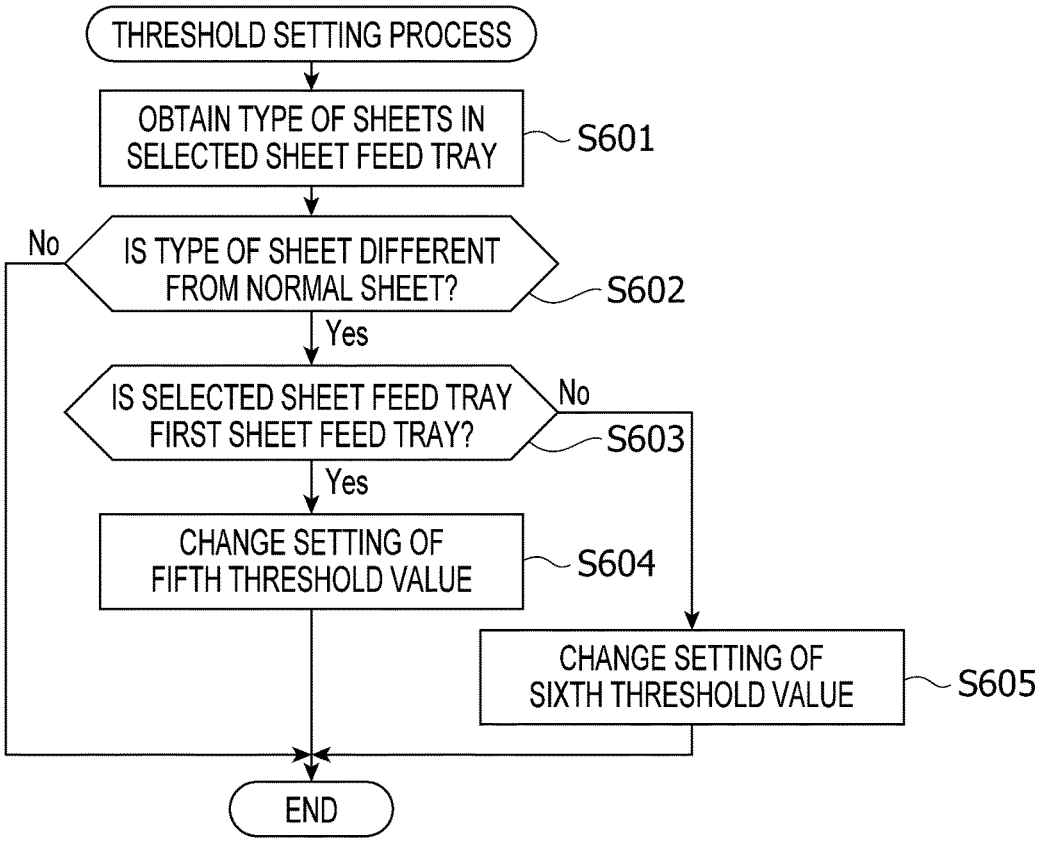
FIG. 15 is a flowchart illustrating a threshold setting process called in the process shown in FIG. 14A.

As shown in FIG. 15, the controller 100 obtains the type of the sheets 81 accommodated in the sheet feed tray which is selected in S301 from the EEPROM 104 (S601). It is noted that the controller 100 may obtain the type of the sheets 81 in the selected sheet feed tray from the RAM 103 in which the received job is stored.

Next, the controller 100 determines whether the type of the sheets 81 obtained in S601 is different from a normal sheet (S602). According to the embodiments, the type of the sheets 81 includes a first type and a second type which is different from the first type. For example, the first type sheets are the normal sheets, while the second type sheets are ones thicker than the first type sheets (e.g., post cards, envelopes, glossy sheets and the like).

When it is determined that the type of the sheets 81 obtained in S601 is "normal" (S602: NO), the controller 100 terminates the threshold setting process. When it is determined that the type of the sheets 81 obtained in S601 is "one different from normal" (S602: YES), the controller 100 determines whether the sheet feed tray selected in S301 is the first sheet feed tray 21A or the second sheet feed tray 21B (S603).

When it is determined that the sheet feed tray selected in S301 is the first sheet feed tray 21A (S603: YES), the controller 100 changes the setting of the fifth threshold value (S604), and then terminates the threshold setting process.

Specifically, the controller 100 changes the fifth threshold value such that the changed fifth threshold value is greater than the fifth threshold value when the first type sheets 81 (i.e., the normal sheets 81) are accommodated in the first sheet feed tray 21A. For example, when the fifth threshold value when the sheet type is "normal" is five, the controller 100 changes the fifth threshold value to, for example, ten when the sheet type is different from "normal."

When it is determined that the sheet feed tray selected in S301 is not the first sheet feed tray 21A (S603: NO), the controller changes the setting of the sixth threshold value (S605), and then terminates the threshold setting process. Specifically, the controller 100 changes the sixth threshold value such that the changed sixth threshold value is greater than the sixth threshold value when the first type sheets 81 (i.e., the normal sheets 81) are accommodated in the second sheet feed tray 21B.

According to the above configuration, similarly to the second illustrative embodiment, it becomes possible to change the timing at which the first alert screen is displayed depending on the type of the sheets when the remaining sheet amount when the sheet feed tray has been attached to the printing system 1 is equal to or less than the first threshold value, and the print operation process is executed as the sheet 81 is supplied from the sheet feed tray attached to the printing system 1.

Specifically, when the second type sheets 81 are accommodated in the sheet feed tray, the timing at which the first alert screen is delayed in comparison with a case where the first type sheets 81 are accommodated in the sheet feed tray.

As described above, according to the third illustrative embodiment, the timing at which the first alert screen is displayed is changed depending on the type of the sheets 81. The reason why the timing is changed is indicated below. When the remainder sensor is configured to stepwisely detect the remaining sheet amount in the sheet feed tray by the height of the sheets 81, depending on the thickness of the sheet, the number of sheets for one step is different. Further, the second type sheet such as the glossy sheet is generally thicker than the first type sheet (i.e., the normal sheet).

Therefore, even if the heights of the sheets in the sheet feed tray are the same, the timings at which the number of sheets in the sheet feed tray becomes zero after supplying of the sheets 81 from the sheet feed tray was started are different depending on whether the sheets are the first type ones or the second type ones (e.g., the numbers of printed sheets until the remaining sheet amount becomes zero are different depending on the thickness of the sheets). Thus, if the fifth/sixth threshold value is not changed regardless of the sheet types, the first alert screen may be displayed more frequently when the second type sheets are used in comparison with a case where the first type sheet are used, which is bothersome to the user. Further, the second type sheets are used for printing less frequently in comparison with the first type sheets. Therefore, it is preferable that the fifth/sixth threshold value is set to an appropriate value for the first type sheets.

Therefore, according to the third illustrative embodiment, when the second type sheets are accommodated in the sheet feed tray, the timing at which the first alert is displayed is delayed in comparison with a case where the first type sheets are accommodated in the sheet feed tray.

As above, usability is improved in the printing system 1 according to the third illustrative embodiment, as well as in printing system 1 according to the first illustrative embodiment.

According to the above description, any person skilled in the art could derive various improvements and/or other embodiments. In other words, the above-described embodiments should be interpreted as only illustrative ones, which are provided to disclose best modes. Structures and/or functions described above could be substantially modified without departing from aspects of the disclosures. Further, appropriate combinations of a plurality of components disclosed above should also be regarded within aspects of the disclosures.

What is claimed is:

1. A printing system, comprising:

a sheet feed tray;

a tray sensor configured to output a signal corresponding to attachment of the sheet feed tray to the printing system;

a remainder sensor configured to output a signal depending on a remaining sheet amount in the sheet feed tray;

a sheet feeder configured to feed the sheet in the sheet feed tray;

a printer configured to print an image on the sheet fed by the sheet feeder;

a display; and a controller configured to:

in response to receipt of the signal from the tray sensor, detect the attachment of the sheet feed tray to the printing system;

in response to receipt of the signal from the remainder sensor at detecting the attachment of the sheet feed tray, detect an attached-time remaining sheet amount in the sheet feed tray and determine whether the attached-time sheet remaining amount is greater than a threshold value;

control the sheet feeder to feed the sheet from the sheet feed tray and control the printer to print an image on the one of the sheets fed by the sheet feeder;

in response to receipt of the signal from the remainder sensor at end of printing the image, detect a current remaining sheet amount in the sheet feed tray;

determine whether the current remaining sheet amount is greater than the threshold value;

in response to determination that the attached-time sheet remaining amount is greater than the threshold value and determination that the current remaining sheet amount is equal to or less than the threshold value and, execute an alert process corresponding to control the display to display an alert on the display; and in response to determination that the attached-time sheet remaining amount and the current remaining sheet are equal to or less than the threshold value, inhibit executing the alert process.

2. The printing system according to claim 1, wherein, in the alert process, the controller is configured to control the display to display the alert regarding the remaining sheet amount.

3. The printing system according to claim 2, wherein, in the alert process, the controller is further configured to, in response to the current remaining sheet amount being zero before the controller control the printer to start printing, control the display to display the alert regarding the remaining sheet amount being zero.

4. The printing system according to claim 1, wherein the controller is further configured to:

determine a sheet type of the sheet in the sheet feed tray; and set the threshold value depending on the determined sheet type.

5. The printing system according to claim 4, wherein the controller is configured to:

detect the remaining sheet amount by a height of the remaining sheets in the sheet feed tray;

in response to determination that the sheet type is a first type, set a first threshold value; and in response to determination that the sheet type is a second type, set a second threshold value smaller than the first threshold value, the second type representing a thinner sheet than the sheet of the first type.

6. The printing system according to claim 4, wherein the controller is configured to:

detect the remaining sheet amount by a height of the remaining sheet in the sheet feed tray;

in response to determination that the sheet type is a normal type, set a first threshold value; and in response to determination that the sheet type is different from a normal sheet type, set a second threshold value greater than the first threshold value.

7. The printing system according to claim 1, wherein the controller is further configured to display the current remaining sheet amount separately from the alert.

8. A method implemented by a controller for controlling a printing system having a tray sensor for outputting signal corresponding to attachment of a sheet feed tray to the printing system and a remainder sensor for outputting signal depending on a remaining sheet amount in the sheet feed tray, the method comprising:

in response to receipt of the signal from the tray sensor, detecting the attachment of the sheet feed tray to the printing system;

in response to receipt of the signal from the remainder sensor at detecting the attachment of the sheet feed tray, detecting an attached-time remaining sheet amount in the sheet feed tray and determining whether the attached-time sheet remaining amount is greater than a threshold value;

controlling a sheet feeder of the printing system to feed the sheet from the sheet feed tray and control a printer of the printing system to print an image on the one of the sheets fed by the sheet feeder;

in response to receipt of the signal from the remainder sensor at end of printing the image, detecting a current remaining sheet amount in the sheet feed tray;

determining whether the current remaining sheet amount is greater than the threshold value; and execute an alert process corresponding to control the display to display an alert regarding the remaining sheet amount on the display, wherein, in response to determination that the attached-time sheet remaining amount and the current remaining sheet are equal to or less than the threshold value, the method inhibits executing the alert process.

* * * * *